US007861360B2

(12) United States Patent
Malka

(10) Patent No.: US 7,861,360 B2
(45) Date of Patent: Jan. 4, 2011

(54) HAIRBRUSH

(75) Inventor: Aharon Malka, Jerusalem (IL)

(73) Assignee: M.L.A. Developement and International Trade Ltd., Jerusalem (IL)

( * ) Notice: Subject to any disclaimer, the term of this patent is extended or adjusted under 35 U.S.C. 154(b) by 761 days.

(21) Appl. No.: 11/666,708

(22) PCT Filed: Mar. 8, 2007

(86) PCT No.: PCT/IL2007/000301

§ 371 (c)(1),
(2), (4) Date: Jul. 30, 2007

(87) PCT Pub. No.: WO2007/102160

PCT Pub. Date: Sep. 13, 2007

(65) Prior Publication Data

US 2008/0230082 A1 Sep. 25, 2008

(30) Foreign Application Priority Data

Mar. 9, 2006 (IL) ..... 174220

(51) Int. Cl.
*A46B 17/06* (2006.01)

(52) U.S. Cl. ..... 15/169; 15/184; 132/119; 132/121

(58) Field of Classification Search ..... 15/119, 15/184; 119/628; 132/119, 120–123
See application file for complete search history.

(56) References Cited

U.S. PATENT DOCUMENTS 1,303,500 A * 5/1919 Rosenberg ..... 15/246
2,529,927 A * 11/1950 Fisk ..... 15/159.1
3,055,033 A * 9/1962 Kaye et al. ..... 15/184
3,065,757 A 11/1962 Peilet
3,577,580 A * 5/1971 Rand ..... 15/169
3,765,049 A * 10/1973 Green et al. ..... 15/169
4,225,997 A 10/1980 Thomas et al.
4,574,416 A * 3/1986 Stewart et al. ..... 15/169
5,133,103 A * 7/1992 Nagasawa ..... 15/184
5,862,563 A 1/1999 Hartmann
5,926,902 A 7/1999 Pierre
6,021,542 A 2/2000 Norman
6,595,219 B2 7/2003 Anderson
2002/0078971 A1 6/2002 Anderson

FOREIGN PATENT DOCUMENTS

| | | | |
|---|---|---|---|
| DE | 10 39 994 | | 10/1958 |
| DE | 20 2004 003084 | | 7/2004 |
| EP | 0 240 006 | | 10/1987 |
| FR | 2 854 310 | | 11/2004 |
| JP | 2003-210251 | * | 7/2003 |
| RU | 2186514 | | 8/2002 |

* cited by examiner

*Primary Examiner*—Mark Spisich
(74) *Attorney, Agent, or Firm*—Roach Brown McCarthy & Gruber, P.C.; Kevin D. McCarthy

(57) ABSTRACT

A hairbrush for allowing trapped hair to be easily removed therefrom. The hairbrush comprises a handle for grasping the hairbrush and a head joined to the handle. The head comprises an array of bristles that protrude through a layer having an array of corresponding apertures. In an initial position the bristles fully protrude through the apertures. In a final position the layer is shifted to the free ends of the bristles. By shifting said hairbrush from an initial position to a final position tangled hair is gathered along the layer and easily removed from the hairbrush.

9 Claims, 39 Drawing Sheets

D-D

L-L

HAIRBRUSH

CLAIM OF PRIORITY

This application claims priority to international application number PCT/IL12007/000301, filed on Mar. 8, 2007; which claims priority to Israeli patent application number 174220, filed on Mar. 9, 2006.

FIELD OF THE INVENTION

The present invention relates in general to hairbrushes. In particular, the invention relates to hairbrushes that allow trapped hair to be easily removed therefrom.

BACKGROUND OF THE INVENTION

One of the most common household items is a hairbrush (also referred to herein as, "brush"). Men and women, both young and old, utilize brushes daily, often more than once a day, for brushing, tidying and detangling hair. Typically, a comb is used for grooming shorter hair, while a brush is used for longer hair. When using the brush, hairs that get pulled out of their follicles or have fallen out by themselves typically become trapped and intertwined among the bristles. In order to maintain the effectiveness of the brush, the user will clean the brush by picking out the trapped hairs from the bristles by hand and/or running the brush under, or soaking the brush in water.

Depending on the amount of hair that becomes trapped among the bristles per use, it may be desirable to clean the brush after each use. Such a process is time consuming and may become frustrating due to the recurring need to clean the brush.

There have been numerous attempts to produce a brush that allows a user to easily remove trapped hairs, thereby reducing the time spent on the brush cleaning process. However, many of these brushes comprise removable and/or breakable components, and require a certain amount of skill to use. Additionally, many of these brushes do not have the appearance of conventional hairbrushes, which may be difficult for the consumer to get used to.

U.S. Pat. No. 5,862,563 discloses a hairbrush body having a handle at one longitudinal end and a face out of which an array of bristles project, at the other longitudinal end. The interior of the body of the hairbrush is essentially hollow except for a plurality of springs that are mounted upright along the length of the brush, for supporting a plate to which the array of bristles is affixed. An arcuate cleaning plate having an array of apertures through which the bristles protrude, is fixedly situated at the upper surface of the face of the brush. The supporting plate comprises a push button extending upward through the handle, such that by pressing down on thereon, the springs are compressed and the supporting plate as well as the bristles are lowered into the interior of the brush. Hairs trapped among the bristles are gathered at the surface of the cleaning plate, and may be removed therefrom. The push button preferably extends upward a distance equal to the length of the bristles, such that when pressing down on the push button, all of the bristles may extend below the arcuate surface, thereby allowing all of the trapped hair to be lifted all the way to the free ends of the bristles. Due to the location of the push button, holding the handle while brushing is difficult and awkward. Additionally, the user may inadvertently press down on the push button while brushing her hair, causing discomfort.

U.S. Pat. No. 6,595,219 discloses a hairbrush with retractable bristles. The body of the hairbrush comprises a hollow chamber, comprising a handle portion and a head portion. An array of bristles is affixed to the flat upper surface of a wedge shaped member that is situated within the head portion. The cam surface of the wedge shaped member is supported by a roller attached to a linking arm that is situated in the handle portion. In an initial position, the bristles protrude through the apertures in the cover face of the head portion. A plurality of compressed springs is situated between the cover face and the flat upper surface of the wedge member. When sliding the linking arm towards the longitudinal end of the handle portion, away from the wedge member, the springs force the wedge member, and thereby the bristles, downward into the hollow chamber of the head, to the retracted position. The linking arm travels within the handle portion by sliding a protruding stub from one end of the handle to the other. During the brushing procedure, the stub may be inadvertently slid, causing discomfort and requiring the mechanism to be reset in place.

U.S. Pat. No. 5,926,902 discloses a hairbrush having a liftable cleaning plate. In an initial position, the plate rests at the base of the bristles and is secured in place by a removable bracket situated at the longitudinal tip of the brush head. The removable bracket is a small component that may be easily misplaced and lost.

U.S. Pat. No. 6,021,542 discloses a self cleaning hairbrush having a pad with multiple layers of cleaning sheets situated at the base of the bristles. Each cleaning sheet is pulled upward and stripped from the brush, removing hair trapped among the bristles along with it. After using up the original pad, the device reverts to a conventional hairbrush.

RU 2,186,514 discloses a hairbrush comprising an elongated handle, the lower tip of which is rotatable about the longitudinal axis of the handle, an oval shaped head portion joined at one end to the handle, and a shaft that runs from the lower tip of the handle, through the handle, along the length of the backside of the head portion. A plate for raising and lowering is situated, in its initial position, at the base of the brush's bristles. Lifting means is situated along the shaft at the underside of the head portion. The lifting means comprises two pairs of identical mechanisms. Each pair comprises two bolts oppositely threaded on the shaft, wherein each bolt comprises an arm extending from each side of the bolt, to opposite transverse edges of the head portion. The distal end of each arm extends to, and is situated at, the outer surface of the head portion. Each of two linking elements are pivotally joined at each of their first ends to each other, and at each of their second ends to one of each distal end of adjacent arms, situated at the same transverse side of the head portion, exposed to the surroundings external to the brush. Thus, linking elements are also situated at the outer surface of the head portion. The first ends of the linking elements that are pivotally joined to each other are further joined to the plate. When rotating the rotatable tip in one direction, the bolts, as well as the second ends of the linking elements are shifted toward each other along the shaft, thereby causing the first end of the linking elements to travel upward. This causes the plate to rise, and the trapped hair along with it, such that the hair may be removed therefrom. However, since the linking elements are exposed, hair may get caught therein during brushing, and inadvertently pull out hairs from their follicles, causing pain to the user. Additionally, if the brush is stored in a purse or handbag, articles such as key chains, clips, etc. may get caught by the linking elements and cause damage to the elements. Even worse, if the linking elements comprise any sharp edges, the user may get injured during use. Moreover, the linking elements are aesthetically unpleasing and may be undesirable to a consumer who prefers the appearance of a conventional hairbrush.

It is therefore an object of the present invention to provide an improved hairbrush for allowing trapped hair to be easily removed therefrom, and which overcomes the drawbacks of the prior art.

It is an additional object of the present invention to provide an improved hairbrush that has an outer appearance of a conventional hairbrush.

It is an additional object of the present invention to provide an improved hairbrush that does not contain any dangerous or unsightly components.

It is an additional object of the present invention to provide an improved hairbrush that does not require any skill to use.

It is an additional object of the present invention to provide an improved hairbrush that is inexpensive to produce and maintain.

Additional objects and advantages of the present invention shall become apparent as the description proceeds.

SUMMARY OF THE INVENTION

The present invention relates to a hairbrush for allowing trapped hair to be easily removed therefrom by shifting said hairbrush from an initial position to a final position, said hairbrush comprising:

a. a handle for grasping said hairbrush; and, b. a head joined to said handle comprising:

i. a shiftable portion comprising:

1. a shiftable plate comprising an array of bristles projecting therefrom;
2. a supporting layer for supporting said plate;
3. an inner frame surrounding said shiftable plate and supporting layer; and,
4. a pair of releasing members situated within said supporting layer;

ii. a fixed portion comprising:

1. a fixed upper plate comprising an array of apertures through which said bristles protrude; and,
2. an outer frame surrounding said fixed plate; and, wherein said releasing members are shiftable between an initial position and a shifted position, and wherein when said releasing members are in said initial position, said brush is in said initial position and said shiftable portion is prevented from being shifted and when said releasing members are in said shifted position said brush is in said final position said shiftable portion is shiftable relative to said fixed portion.

When the releasing members are in the shifted position a spring element urges said releasing members to return to the initial position. The spring element may be an integral component of the releasing element. Alternatively, the spring element is an independent component of the shiftable portion.

The present invention further relates to a hairbrush for allowing trapped hair to be easily removed therefrom by shifting said hairbrush from an initial position to a final position. The first embodiment of said hairbrush comprises:

a. a handle for grasping said hairbrush, at least a portion of which is rotatable;

b. a head joined to said handle, said head comprising:

i. a fixed lower plate comprising an array of bristles projecting therefrom;

ii. a shiftable upper plate comprising an array of apertures through which said bristles protrude;

c. a rotatable shaft extending from the rotatable portion of said handle along at least a portion of the backside of said lower plate;

d. at least first and second extension members, wherein:

i. each of said extension members is joined at one of its ends to said shaft, and extends orthogonally from the longitudinal axis of said shaft; and, ii. said extension members are joined at the other of their ends to opposite transverse sides of said upper plate, wherein, said handle comprises a first rotated position and a second rotated position, wherein when said handle is in said first rotated position, said upper plate is situated on said lower plate and said brush is in said initial position, and wherein said handle is in said second rotated position, said upper plate is in an upwardly shifted position and said brush is in said final position.

Preferably, the hairbrush further comprises a locking mechanism for maintaining said hairbrush in any one of the group consisting of:

a. the initial position; and, b. the final position.

The present invention relates yet further to a hairbrush for allowing trapped hair to be easily removed therefrom by shifting said hairbrush from an initial position to a final position, said hairbrush comprising:

a. a handle for grasping said hairbrush comprising:

i. a rotatable upper handle member and a rotatable lower handle member; and, ii. a pair of rods extending from each handle member;

b. a head joined to said handle comprising:

i. an inner plate comprising:

1. an array of bristles projecting therefrom;
2. means for hingedly joining said rods to said inner plate;

ii. an elastic outer sleeve surrounding said inner plate and said rods, said sleeve comprising an upper surface having an array of apertures through which said bristles protrude, wherein, said upper and lower handle members comprise a first rotated position and a second rotated position, wherein when said upper and lower handle members are in a first rotated position, said hairbrush is in said initial position, and wherein said upper and lower handle members are in said second rotated position, said hairbrush is in said final position.

According to the second embodiment, in the initial position said hairbrush is usable for brushing hair, and in the final position, said trapped hair is easily removable from said hairbrush.

According to the second embodiment, each handle member is rotatable about its own longitudinal axis.

DETAILED DESCRIPTION OF THE PREFERRED EMBODIMENTS

When utilizing a hairbrush for brushing, tidying and detangling hair, it is common for hair to become trapped among the bristles. In order to maintain the brush's effectiveness, the hair should be regularly removed therefrom. This process is generally undesirable, as it is time consuming and can become frustrating. The present invention solves these problems by providing an improved hairbrush that allows a user to: easily remove hair trapped in the bristles.

Figure 1A:
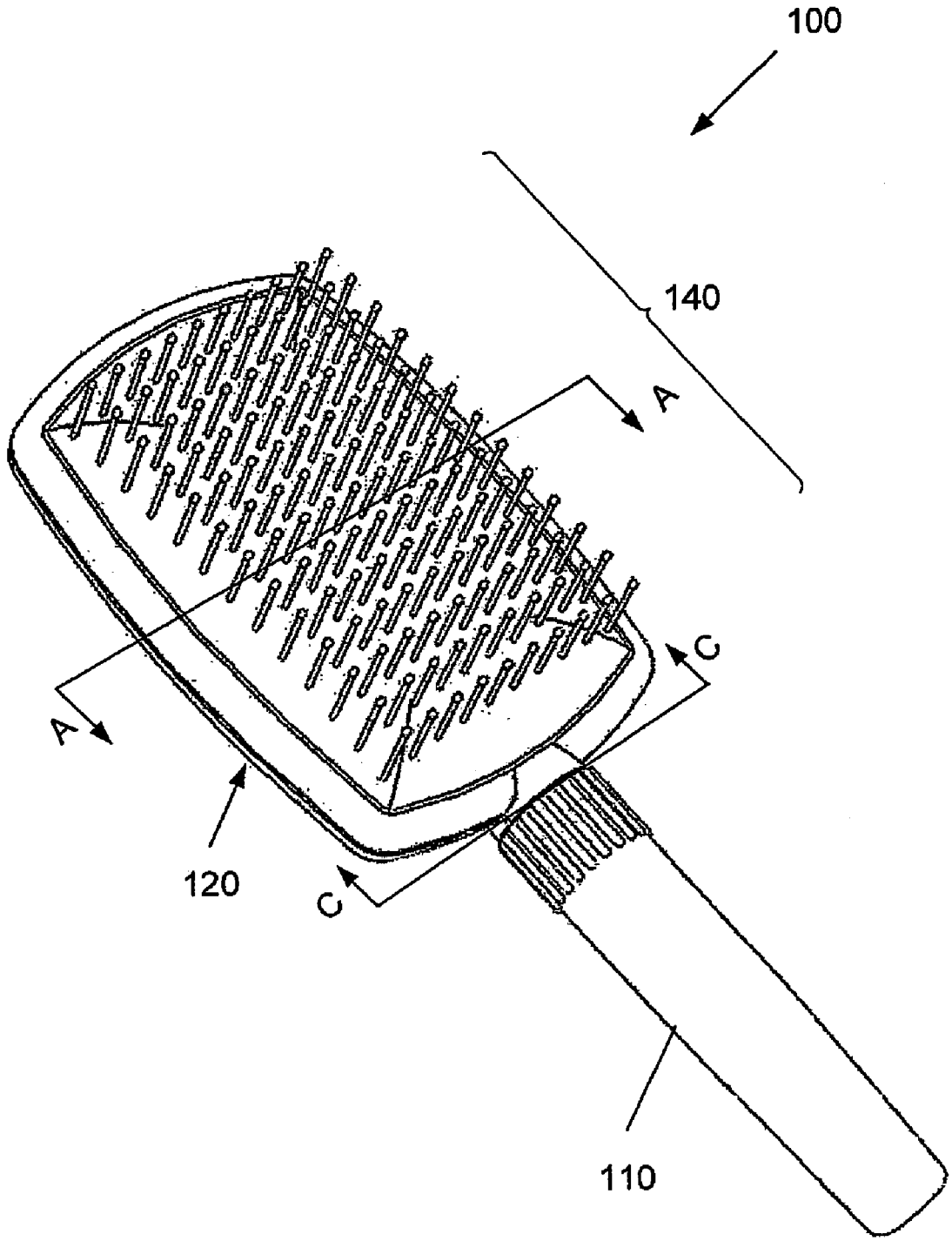
FIGS. 1*a* and 1*b* illustrate a front perspective view (FIG. 1*a*) and a back perspective view (FIG. 1*b*) of the first embodiment of the hairbrush of the present invention.
Figure 1B:
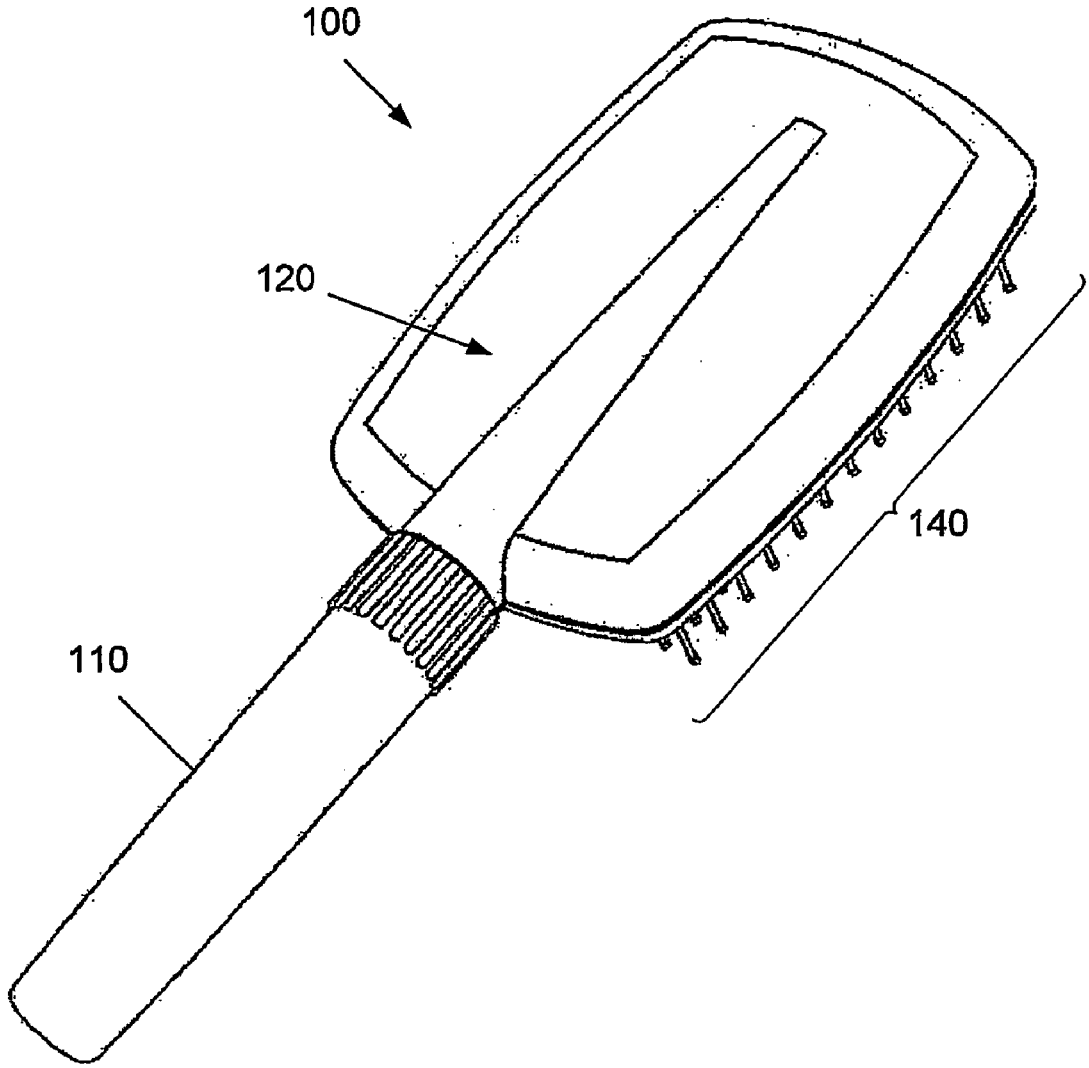
Figure 2:
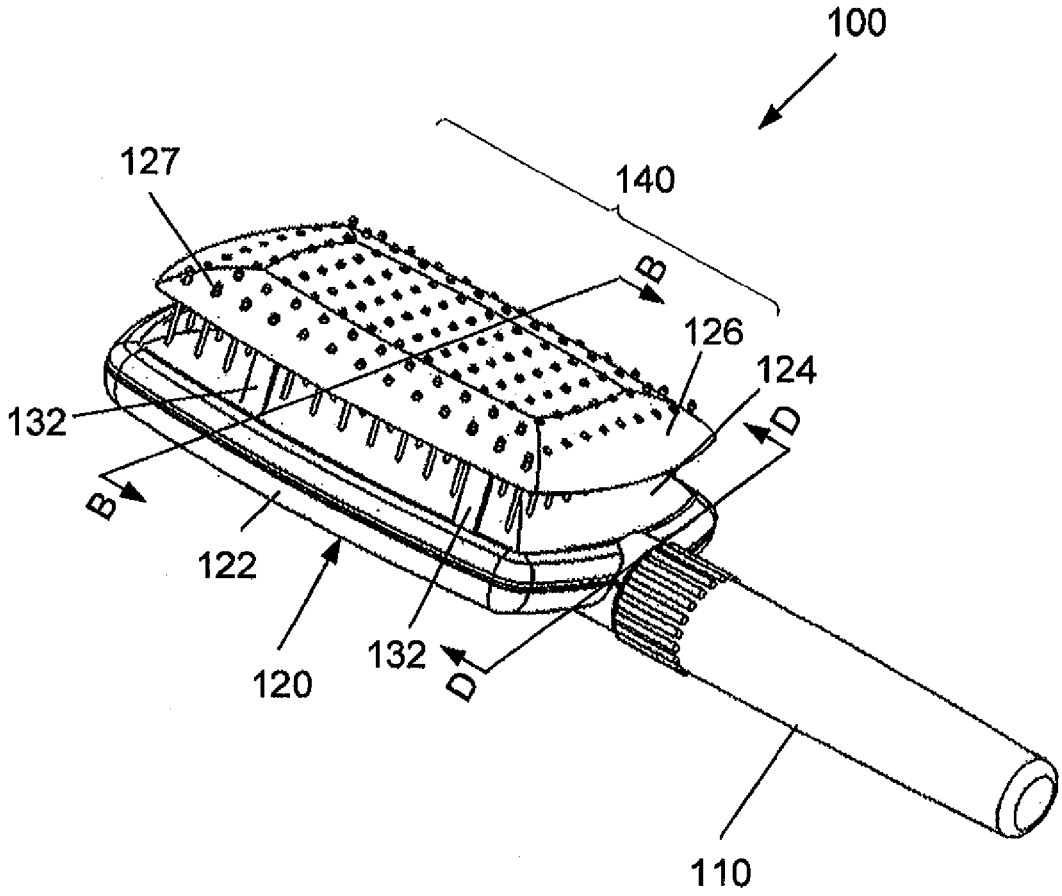
FIG. 2 illustrates the view of FIG. 1*a* wherein the upper plate of the head is shifted upward.

A first embodiment of the hairbrush of the present invention, shown in FIGS. 1*a* and 1*b* and generally designated by the numeral (100), has the appearance of a conventional hairbrush, and comprises an elongated handle (110), a head (120) and bristles (140). Referring to FIG. 2, wherein brush (100) is shown in a hair removal position (also referred to herein as, final position), head (120) is comprised of an outer frame (122), a lower plate (124) from which an array of bristles (140) upwardly project, and a shiftable upper plate (126), shown in an upwardly shifted position. Upper plate (126) comprises an array of apertures (127) through which bristles (140) protrude. Lower plate (124) is fixedly joined at its outer edges to the inner edges of frame (122).

Figure 3:
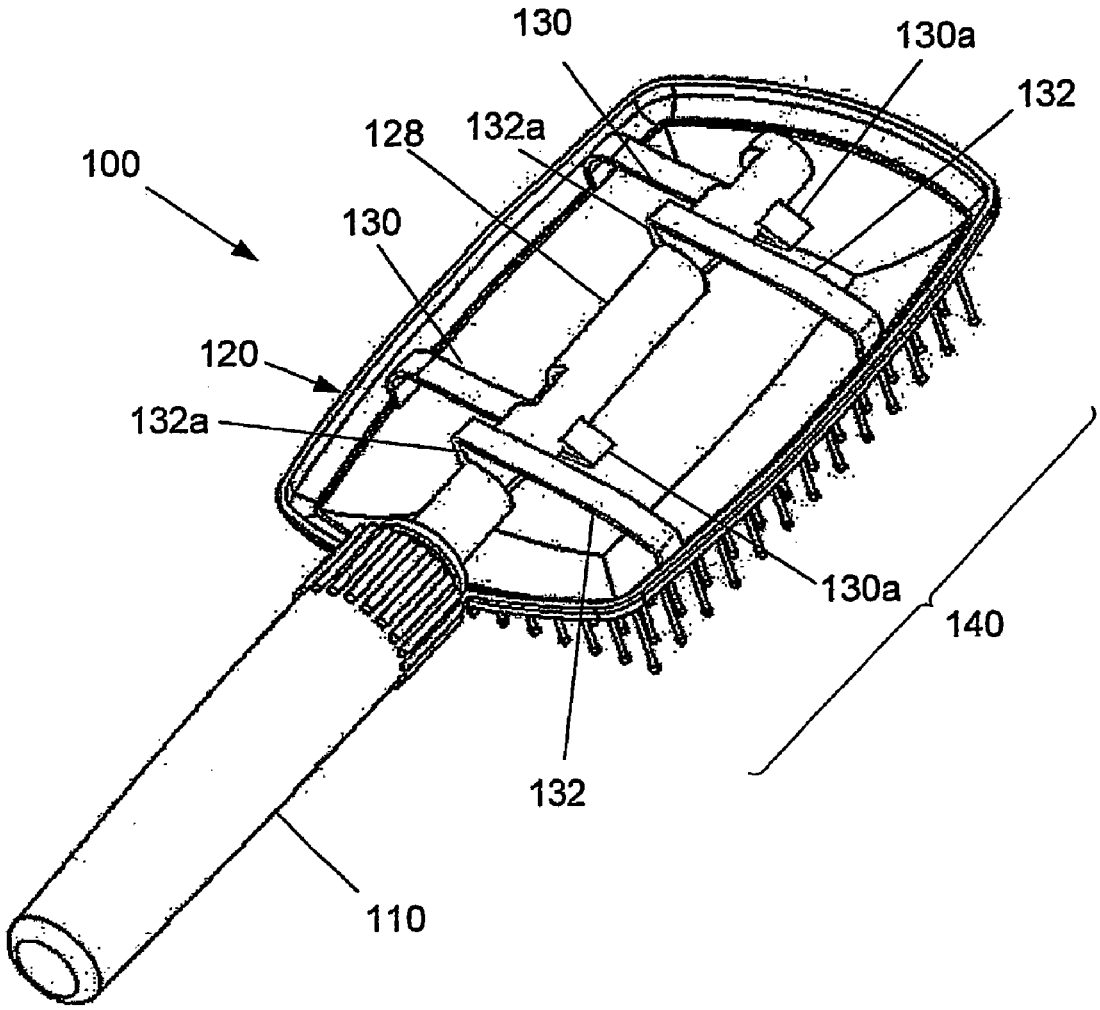
FIG. 3 illustrates the back perspective view of FIG. 1*b*, wherein the back wall of the head is removed to allow the internal components to be seen.

FIG. 3 shows a back perspective view of hairbrush (100) with the back wall of head (120) removed in order to allow the internal mechanism of hairbrush (100) to be seen. Rotatable shaft (128) extends from one longitudinal end of handle (110) along the longitudinal length of the backside of lower plate (124). Shaft (128) may continue the entire length of head (120), or may terminate before reaching the other end of head (120), as shown in the figure.

For purposes of clarity, when referring herein to the, "rotation of shaft (128)", it is to be understood that handle (110) is rotated, which, in turn, causes shaft (128), which is fixedly joined thereto, to rotate. Handle (110) may be rotatable in its entirety, or alternatively, only a portion of handle (110) may be rotatable, wherein shaft (128) extends from the rotatable portion through handle (110). The rotatable portion of handle (110) may be situated at the end of handle (110) that is closest to head (120), or at the free end of handle (110), or anywhere in between.

Two pairs of first and second extension members (130), (132), for raising and lowering upper plate (126) (see FIG. 2), are best seen in FIG. 3. Each of first and second extension members (130), (132) is joined at one of its ends to shaft (128) via joining elements (130*a*) and 132*a*) respectively, and extends in a direction orthogonal to the longitudinal axis of shaft (128). Each of first and second extension members (130), (132) extends through an opening at opposing transverse edges of lower plate (124). Extension members (130), (132) are joined at the other of their ends at opposing positions along the transverse sides of upper plate (126) (see FIG. 2).

Although the figures show two pairs of extension members (130), (132), it is understood that only one pair is necessary for the present invention to operate as described herein. Alternatively, more than two pairs may be present to provide greater stability during operation.

Figure 4A:
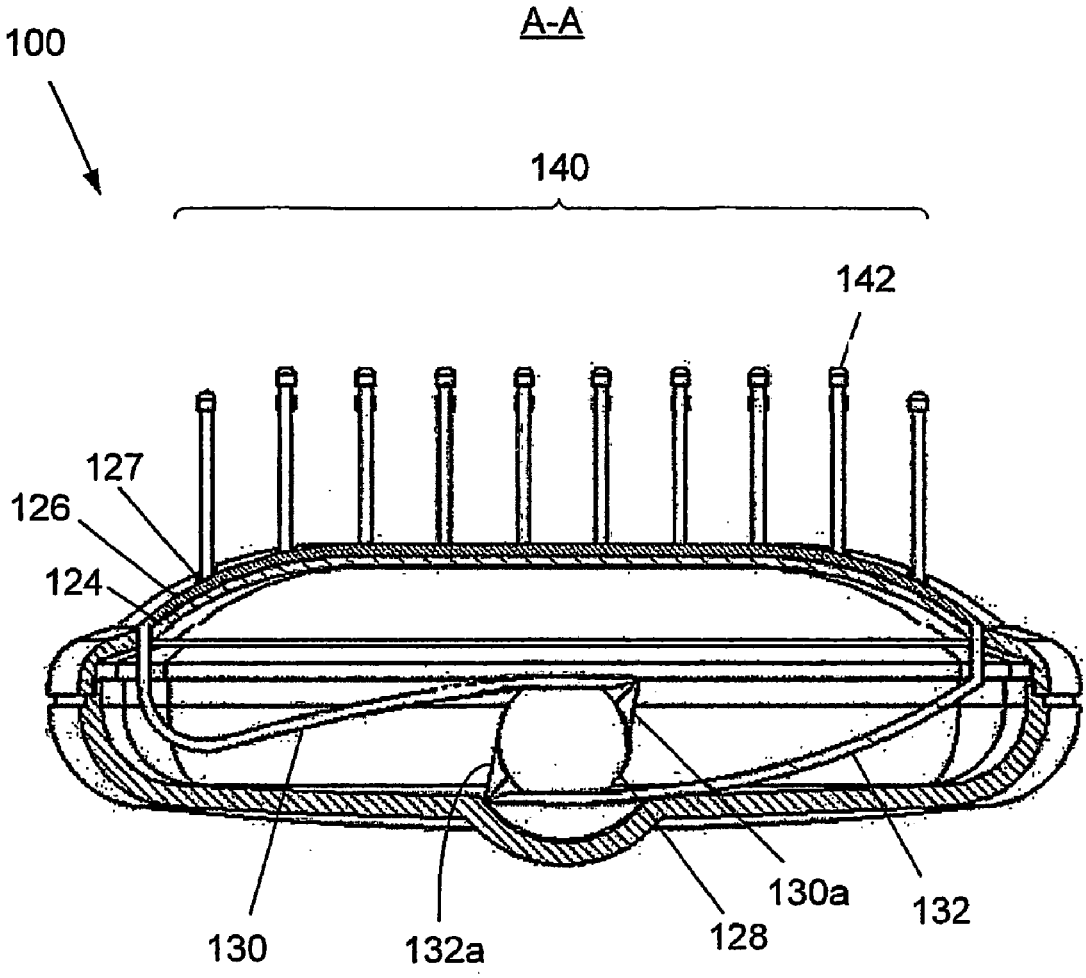
FIG. 4*a* illustrates a cross-sectional view of the first embodiment of the hairbrush in the initial, or brushing position, taken along A-A of FIG. 1*a*.

A cross-sectional view of hairbrush (100), taken along A-A of FIG. 1*a*, is shown in FIG. 4*a*. Hairbrush (100) is in an initial position (also referred to herein as, brushing position), wherein upper plate (126) rests on lower plate (124) such that essentially the entire length of bristles (140) protrude through apertures (127) in upper plate (126).

Figure 4B:
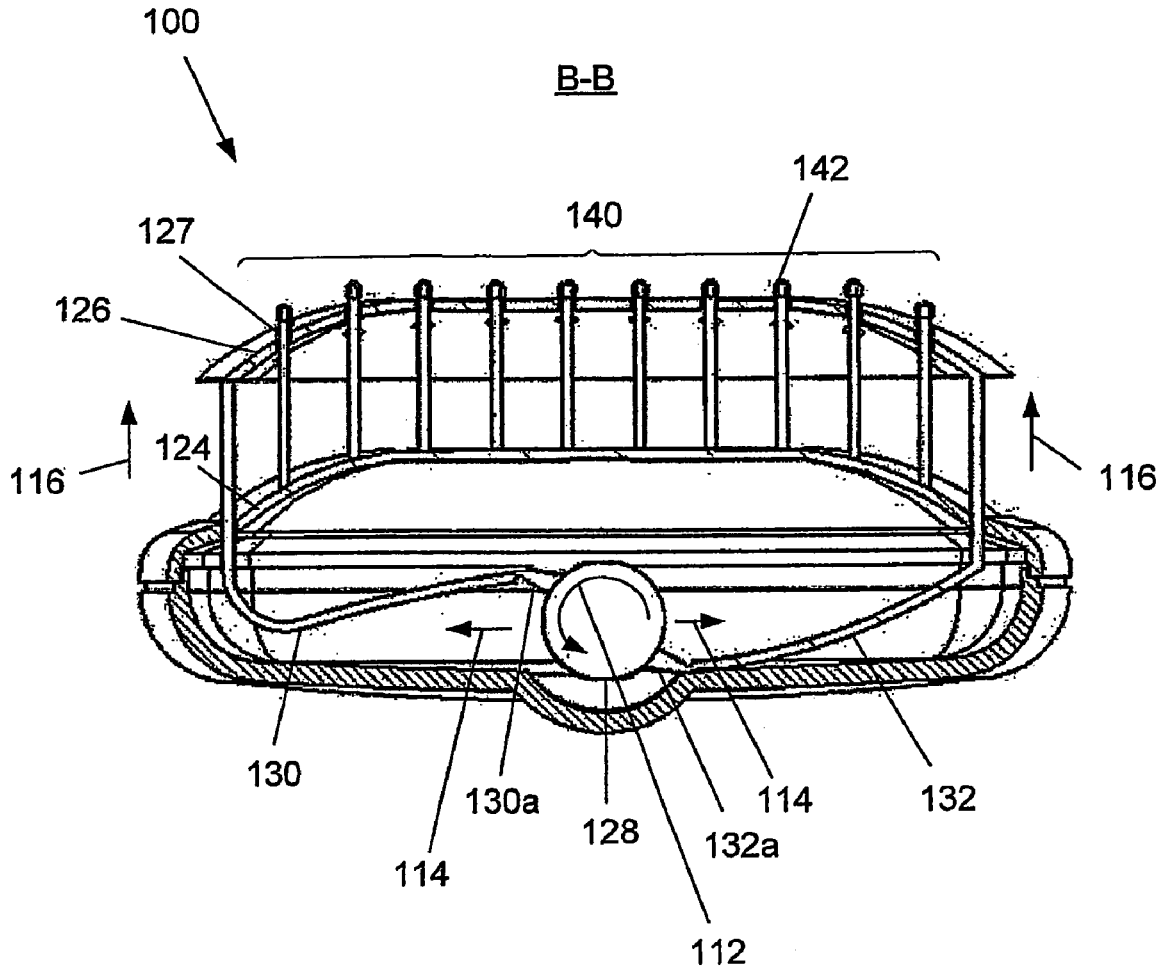
FIG. 4*b* illustrates a cross-sectional view of the first embodiment of the hairbrush in the final, or hair-removal position, taken along B-B of FIG. 2.

FIG. 4*b* shows a cross-sectional view of hairbrush (100), taken along B-B of FIG. 2. Hairbrush (100) is in a final position, wherein upper plate (126) is upwardly shifted to the free ends of bristles (140). As seen in the figures, in particular, FIG. 4*b*, free ends of bristles (140) preferably comprise comfort tip buttons (142). Each button (142) is typically spherical and has a thickness greater than that of each aperture (127) in upper plate (126) through which each associated bristle (140) protrudes. When upper plate (126) is shifted upwardly along bristles (140) such that hairbrush (100) is in the hair-removal position (FIG. 2 and FIG. 4*a*), buttons (142) serve as stoppers for preventing upper plate (126) from sliding off of bristles (140) and decoupling from hairbrush (100). When hairbrush (100) is in the hair-removal position, the hair that was trapped among bristles (140) accumulates to a common plane on the surface of upper plate (126) to allow the hair to be easily removed from hairbrush (100).

The rotational motion of shaft (128) translates into the linear motion of the upper plate (126) shifting upward. As illustrated in FIG. 4*b*, the rotation of the shaft (128) in a first direction, indicated by arrow (112), causes joining elements (130*a*), (132*a*) to rotate, thereby causing first and second extension members (130), (132) to extend in the direction of opposing transverse edges of frame (122), indicated by arrows (114). First and second linking members (130), (132) pass through the opposing transversal openings in lower plate (124) and push upper plate (126) vertically upward, away from lower plate (124), as indicated by arrows (116). The rotation of shaft (128) in a second (opposite) direction results in upper plate (126) shifting downward, returning hairbrush (100) to an initial position.

Figure 5A:
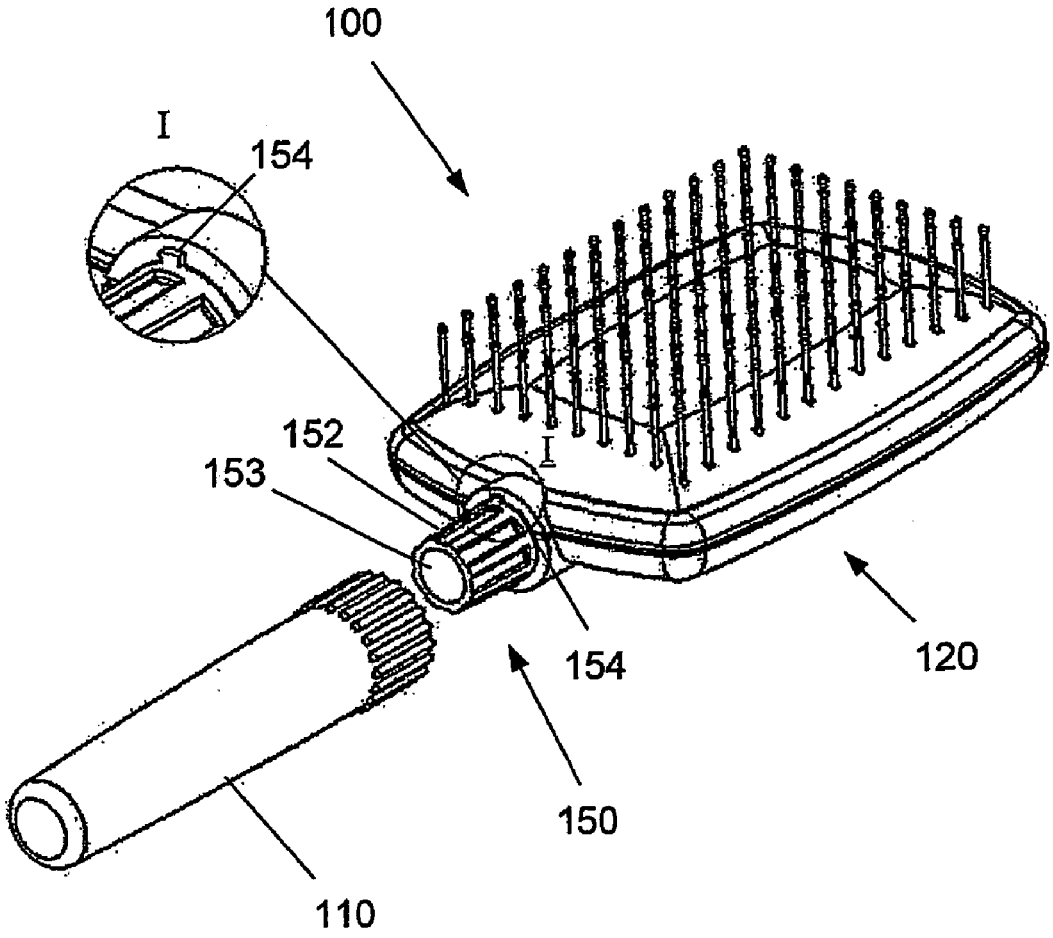
FIG. 5*a* illustrates the locking mechanism of the first embodiment of the hairbrush, wherein the handle is removed.
Figure 5B:
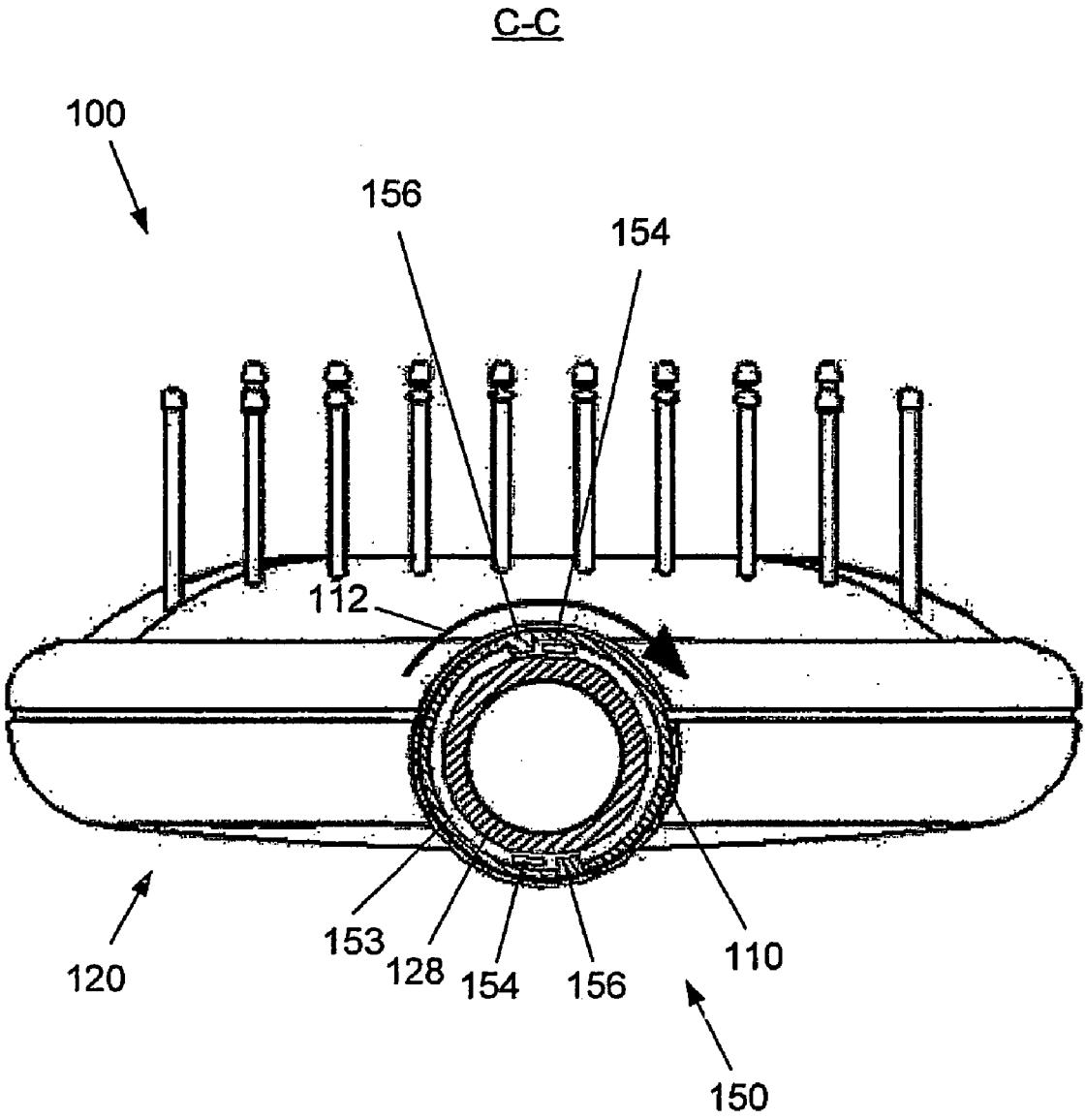
FIG. 5*b* illustrates a cross-sectional view of the first embodiment of the hairbrush taken along C-C of FIG. 1*a*, showing the locking mechanism when the hairbrush is in the initial position.
Figure 5C:
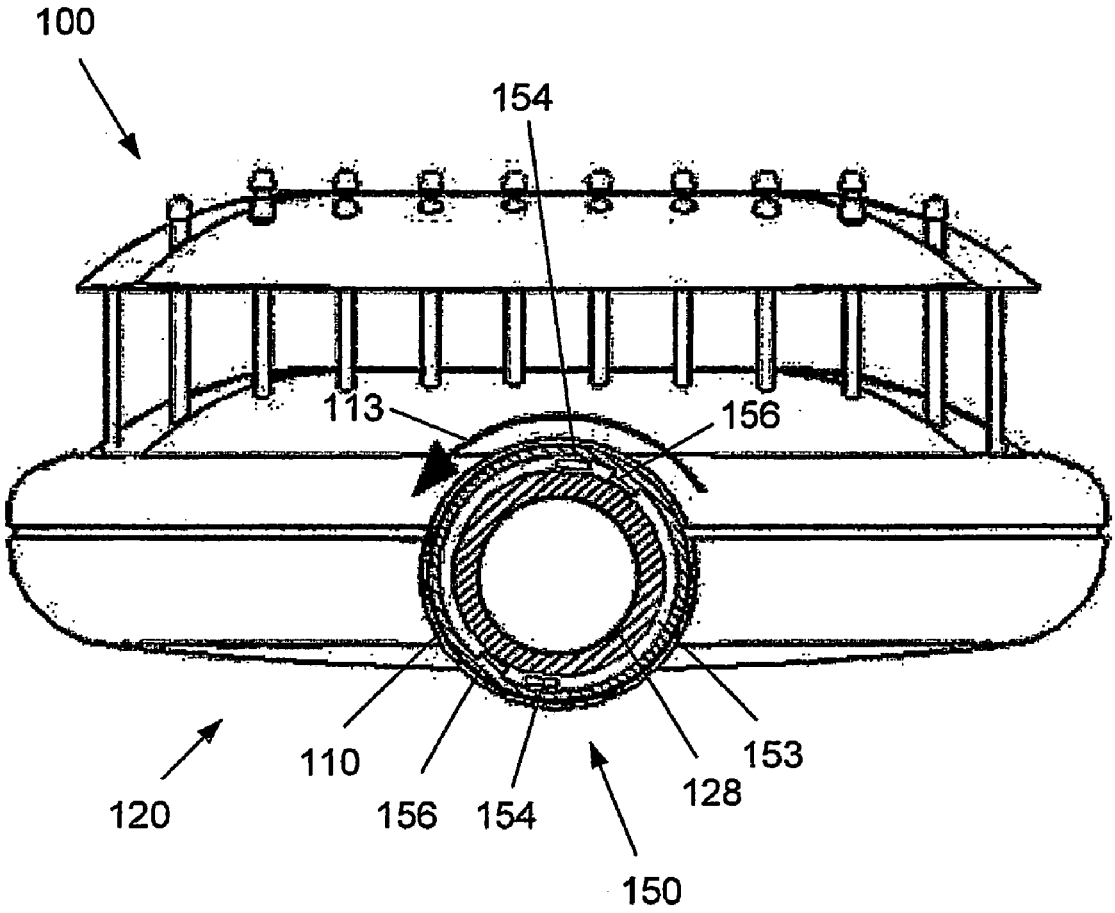
FIG. 5*c* illustrates a cross-sectional view of the first embodiment of the hairbrush taken along D-D of FIG. 2, showing the locking mechanism when the hairbrush is in the final position.

It is desirable for the shaft (128) to be prevented from rotating inadvertently when hairbrush (100) is in either the initial of final position. Therefore, a locking mechanism is provided for preventing such undesirable rotation of the shaft. Locking mechanism (150) is shown in FIG. 5*a* comprising a hollow element (152) fixedly situated at the longitudinal end of head (120) that is in closest proximity to handle (110). Hollow element (152) extends from head (120) and is insertable into handle (110). Shaft (128) (shown in FIGS. 5*b* and 5*c* as described herein below) passes through channel (153) of hollow element (152) and is fixed to the inner surface of handle (110). FIG. 5*b* shows a cross-section of locking mechanism (150) taken along C-C of FIG. 1*a*, wherein brush (100) is in the initial position, and FIG. 5*c* shows a cross-section of locking mechanism (150) taken along D-D of FIG. 2, wherein brush (100) is in the final position. Locking mechanism (150) further comprises two stoppers (154), each of which extends from the outer circumference of hollow element (152) and is fixed with respect to head (120). One stopper (154) is shown in an enlarged view in Detail (1) in FIG. 5*a*. As best, seen in FIGS. 5*b* and 5*c*, two protrusions (156) extend radially inward from the inner surface of handle (110). Each protrusion (156) is situated on opposite sides of one of each stopper (154) such that in the initial position (FIG. 5*b*), handle (110) is prevented from being rotated in the first direction as indicated by arrow (112), without applying an amount of force required to allow each protrusion (156) to slide passed each respective stopper (154). Similarly, when brush (100) is in the final position (FIG. 5*c*), handle (110) is prevented from being rotated in the second (or, opposite) direction as indicated by arrow (113) without applying an amount of force required to allow each protrusion (156) to slide passed each respective stopper (154).

Stoppers (154) may comprise a slight raise in the surface of hollow element (152), and protrusions (156) may comprise a slight raise in the inner surface of handle (110), but are shown in the figures herein as enlarged components for illustrative purposes.

Figure 6A:
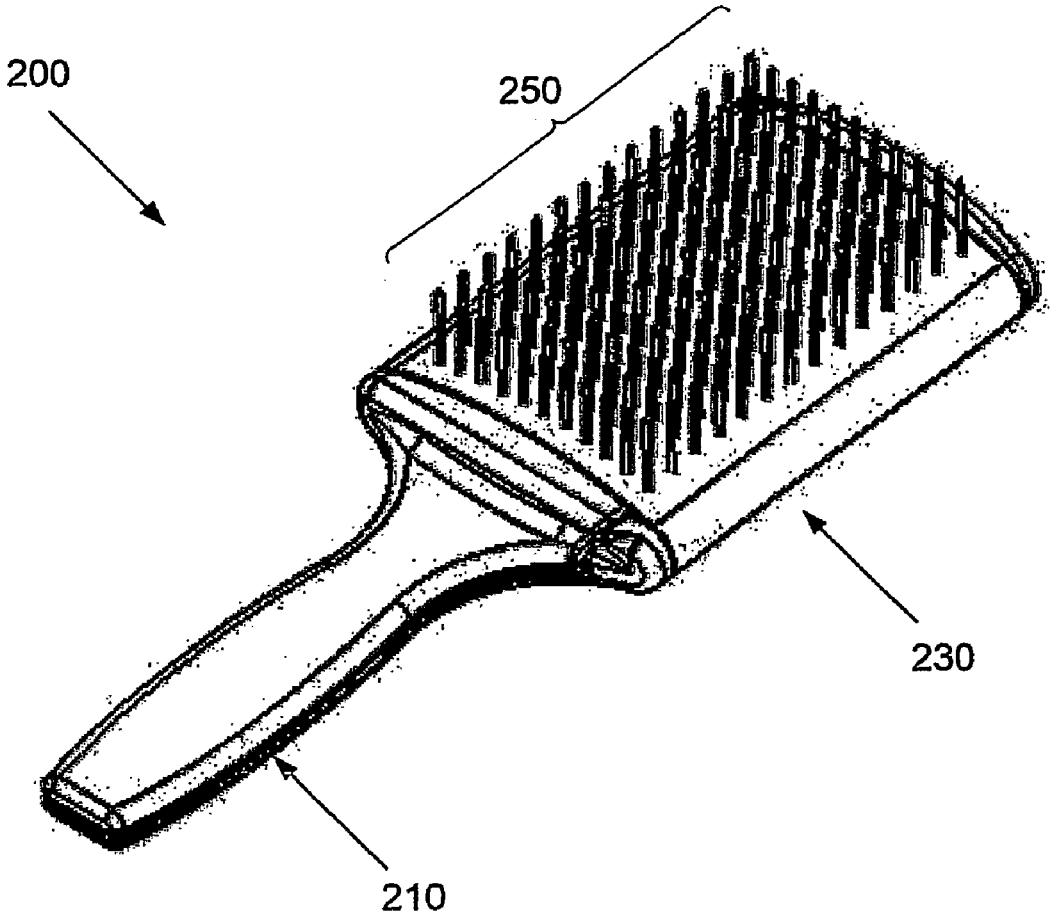
FIGS. 6*a* and 6*b* illustrate a front perspective view of the second embodiment of the hairbrush of the present invention in an assembled view (FIG. 6*a*) and an exploded view (FIG. 6*b*)
Figure 6B:
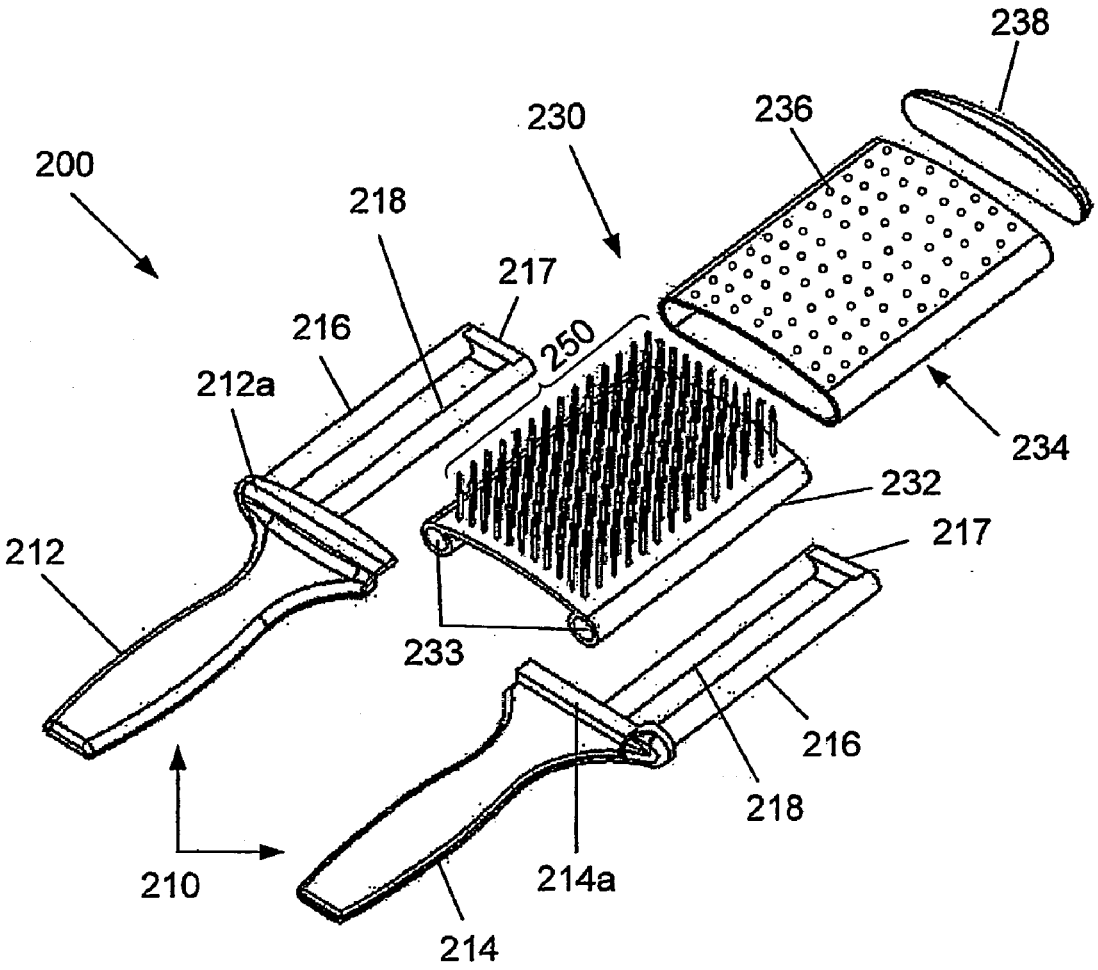

A second embodiment of the hairbrush of the present invention, generally designated by the numeral (200), is shown in an assembled view in FIG. 6*a* and in an exploded view in FIG. 6*b*. Hairbrush (200) has the appearance of a conventional hairbrush, and comprises an elongated handle (210), a head (230) and bristles (250).

As best seen in FIG. 6*b*, handle (210) comprises an upper handle member (212) and a lower handle member (214). Each handle member (212), (214) has a transversal ledge (212*a*), (214*a*) at its longitudinal end that is closest to head (230), from which two essentially parallel rods (216), (218) extend, wherein rod (216) is referred to herein as the outer rod of each handle member (212), (214) and rod (218) is the inner rod of each handle member (212), (214). Outer rod (216) is connected to inner rod (218) by a connecting element (217) situated at their free ends. Head (230) comprises an inner plate (232) having a slightly convex shape, and an array of bristles (250) projecting from its surface, and an elastic outer sleeve (234) having an upper surface (224) comprising an array of apertures (236) through which bristles (250) protrude. Cap (238) is joined to the free end of inner plate (232).

Figure 7:
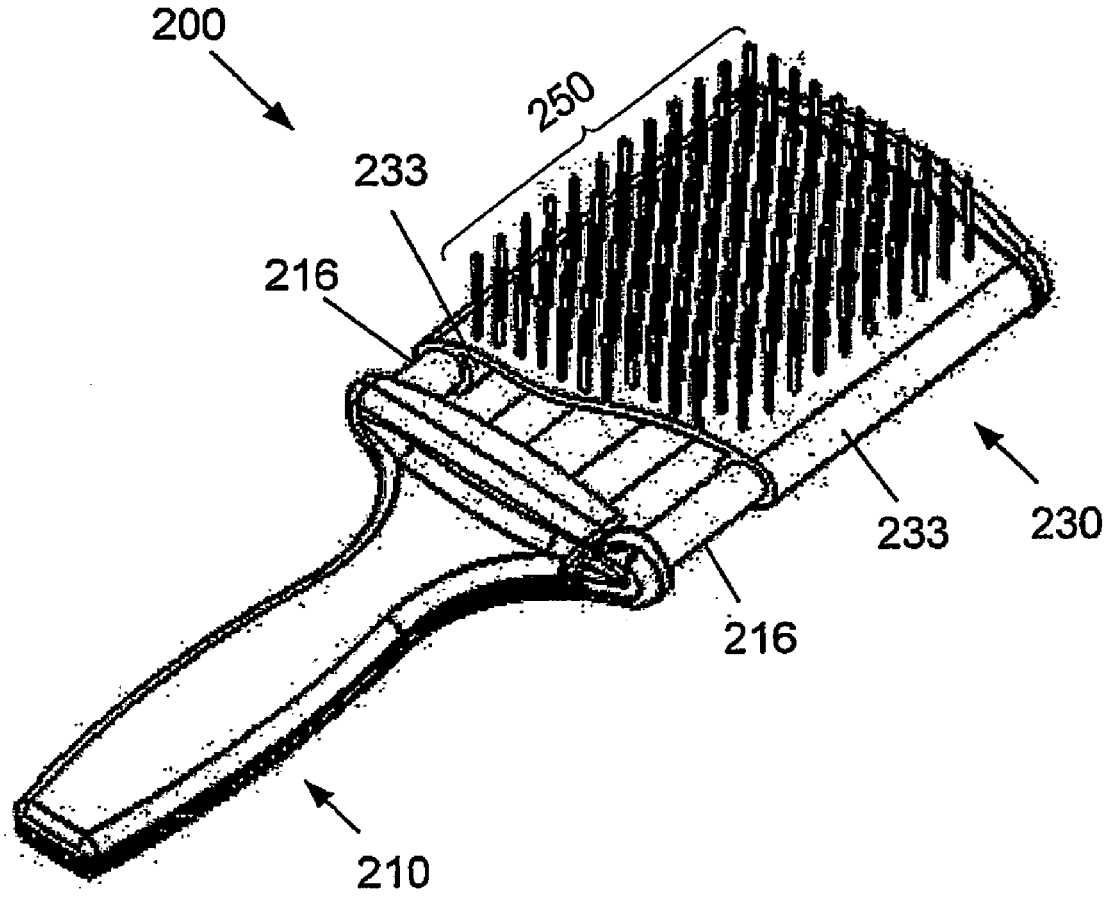
FIG. 7 illustrates the view of FIG. 6*a*, wherein the flexible sleeve is removed, and a portion of the inner plate is cutout for illustrative purposes.

As best seen in FIG. 7, wherein elastic sleeve (234) is removed from the assembled view of hairbrush (200) and a portion of inner plate (232) is cut away, each outer rod (216) is hingedly joined to inner plate (232) by being disposed within one of each outer tube (233), which are integral portions of inner plate (232) and run longitudinally along the length of the transverse edges of inner plate (232).

Figure 8A:
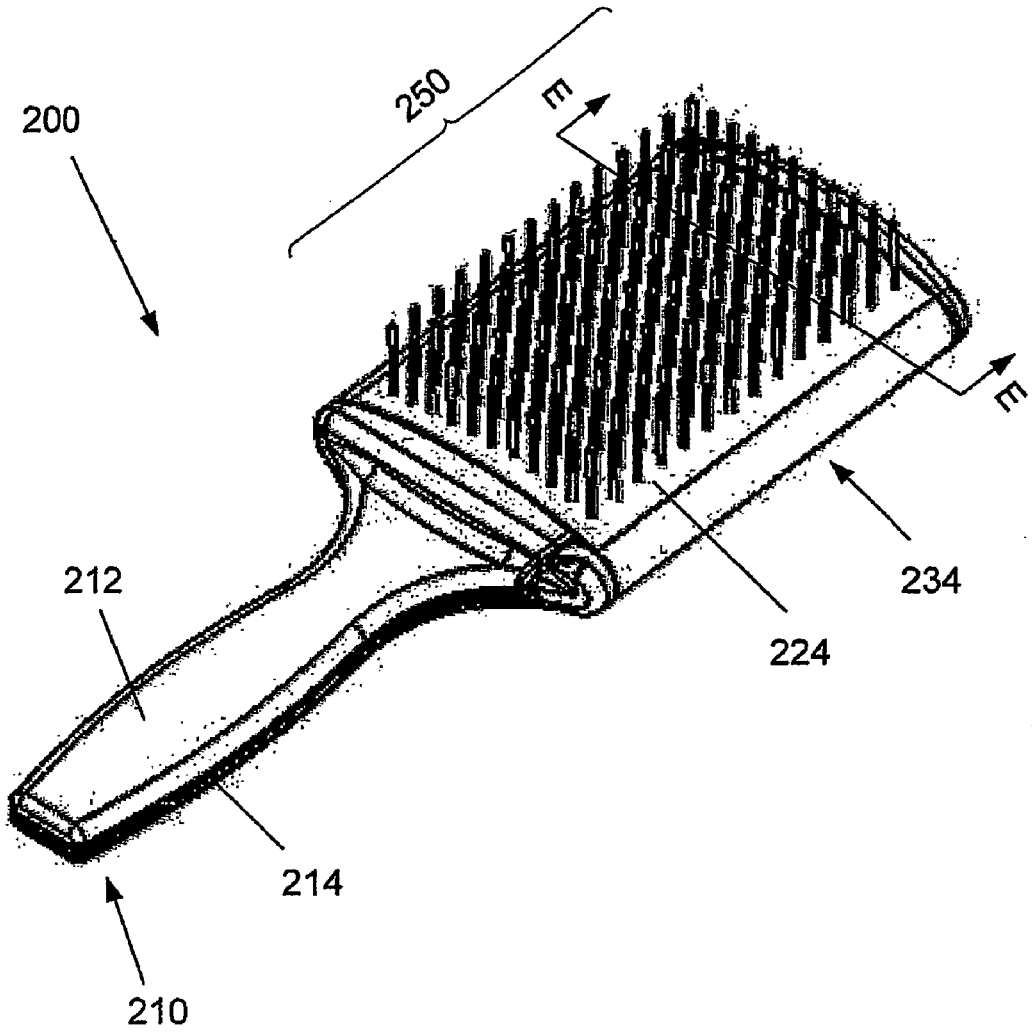
FIGS. 8*a*-8*d* illustrate a perspective view of the sequence of operation required to shift the hairbrush of the second embodiment, from the initial position (FIG. 8*a*) to first intermediate position (FIG. 8*b*) to the second intermediate position (FIG. 8*c*) to the final position (FIG. 8*d*).
Figure 8B:
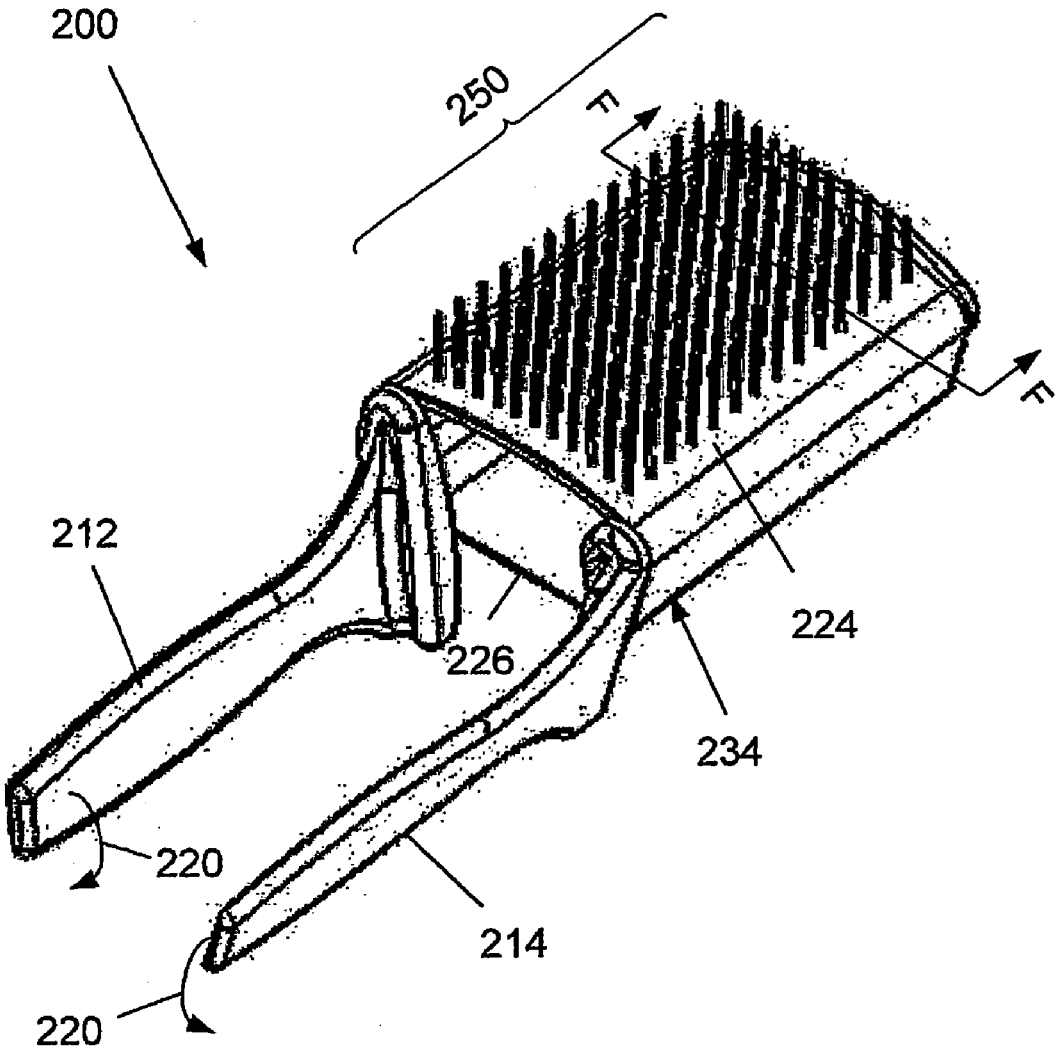
Figure 8C:
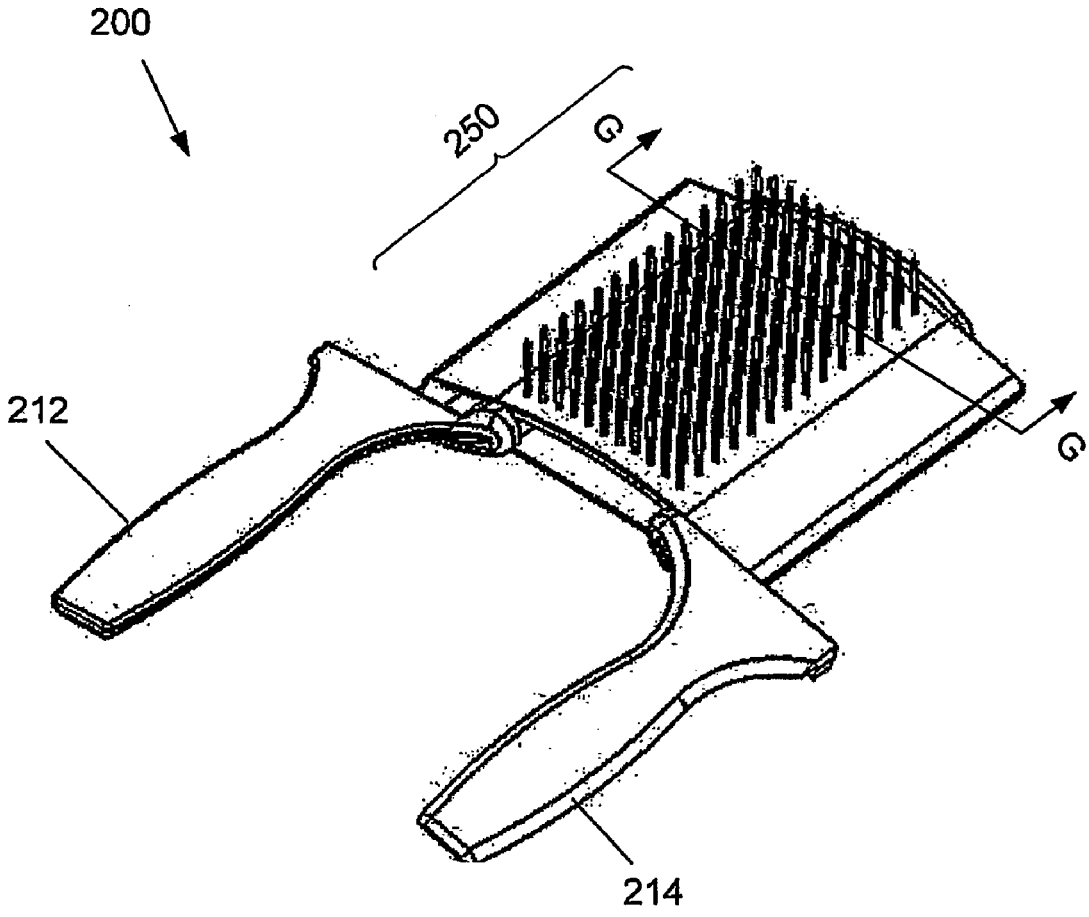
Figure 8D:
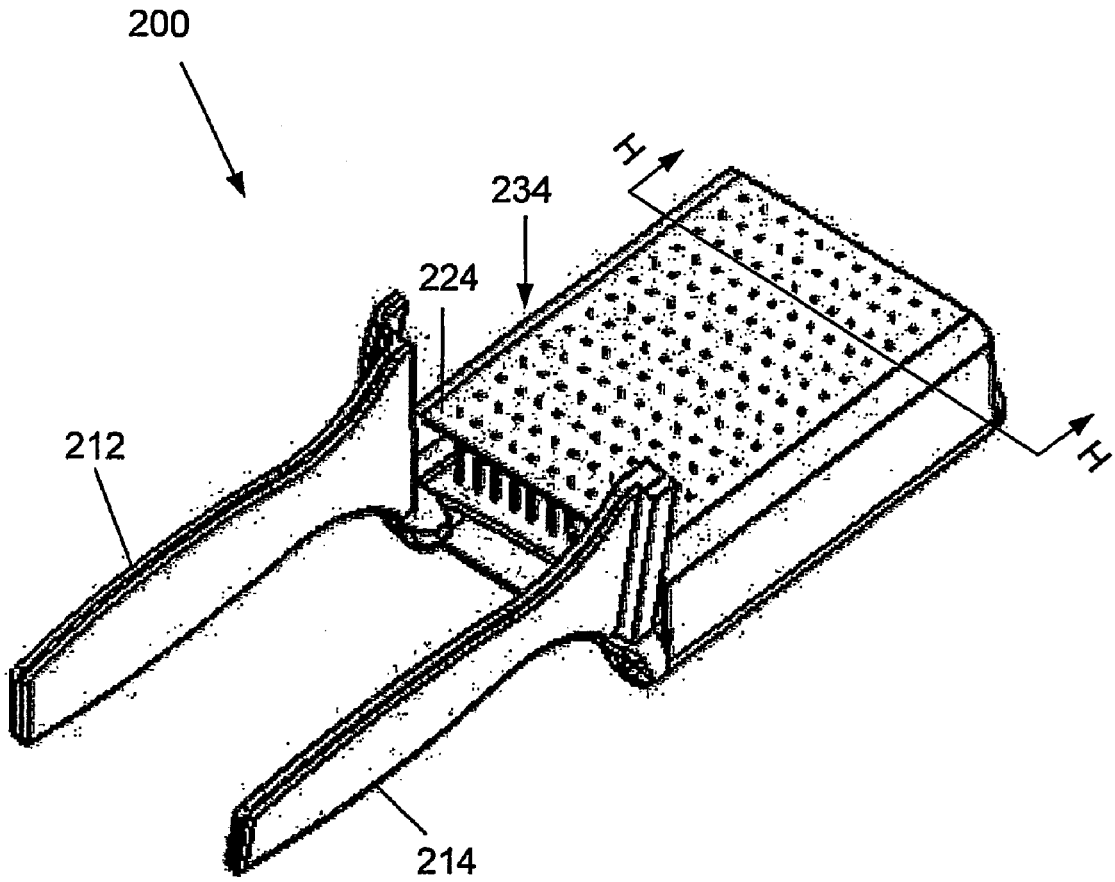
Figure 9A:
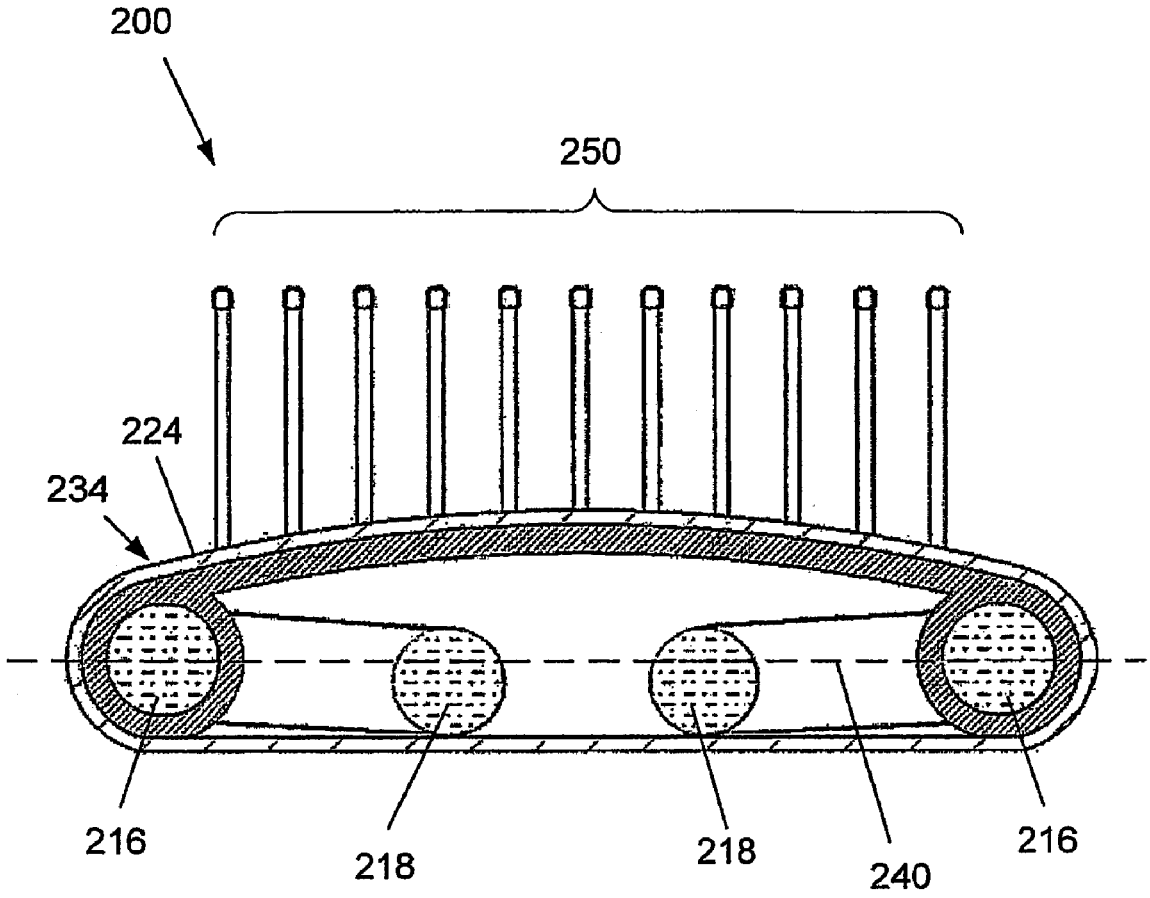
FIGS. 9*a*-9*d* illustrate cross-sectional views taken along E-E (FIG. 9*a*), F-F (FIG. 9*b*), G-G (FIG. 9*c*) and H-H (FIG. 9*d*) of FIGS. 8*a*-8*d* respectively.
Figure 9B:
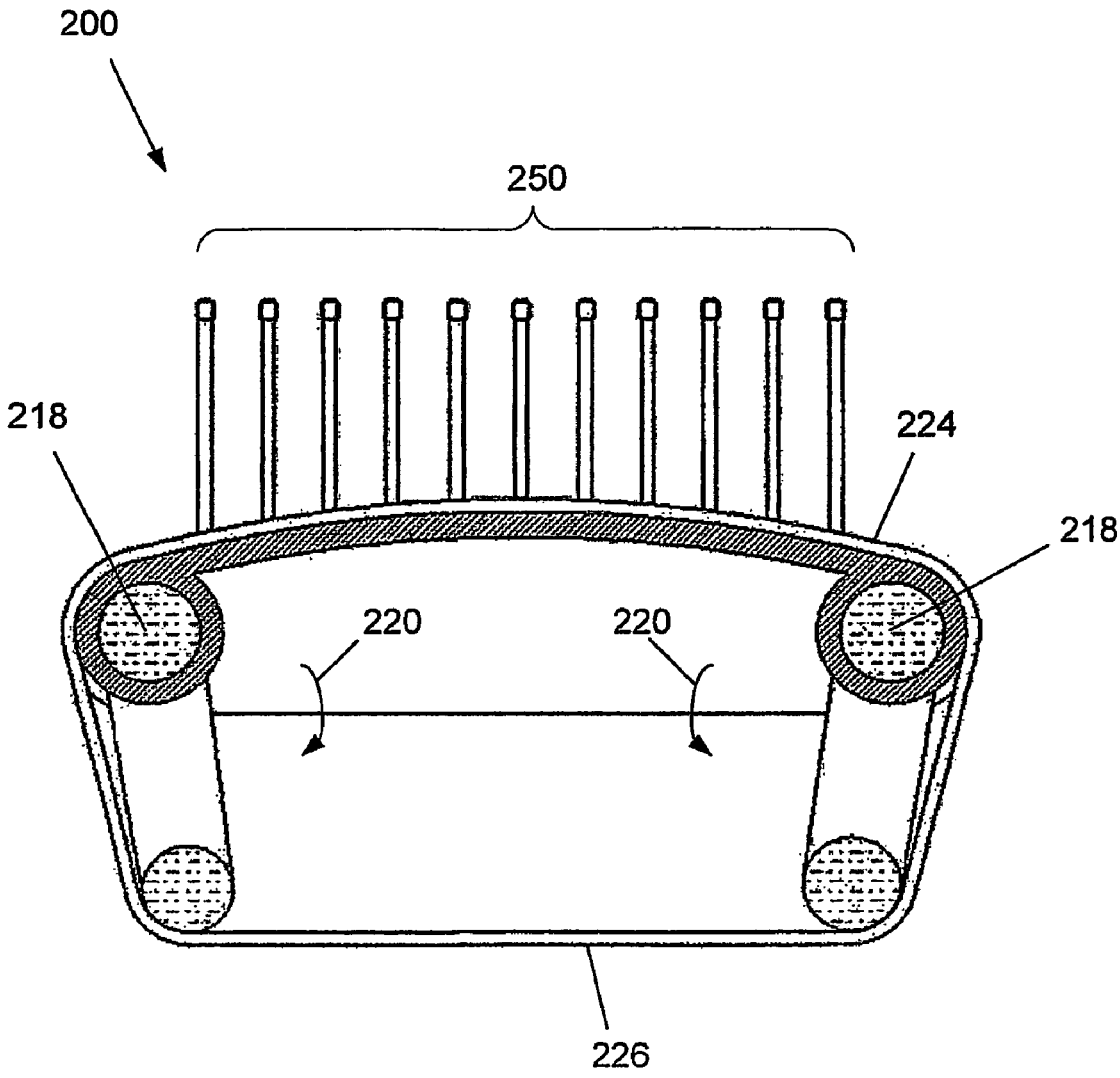
Figure 9C:
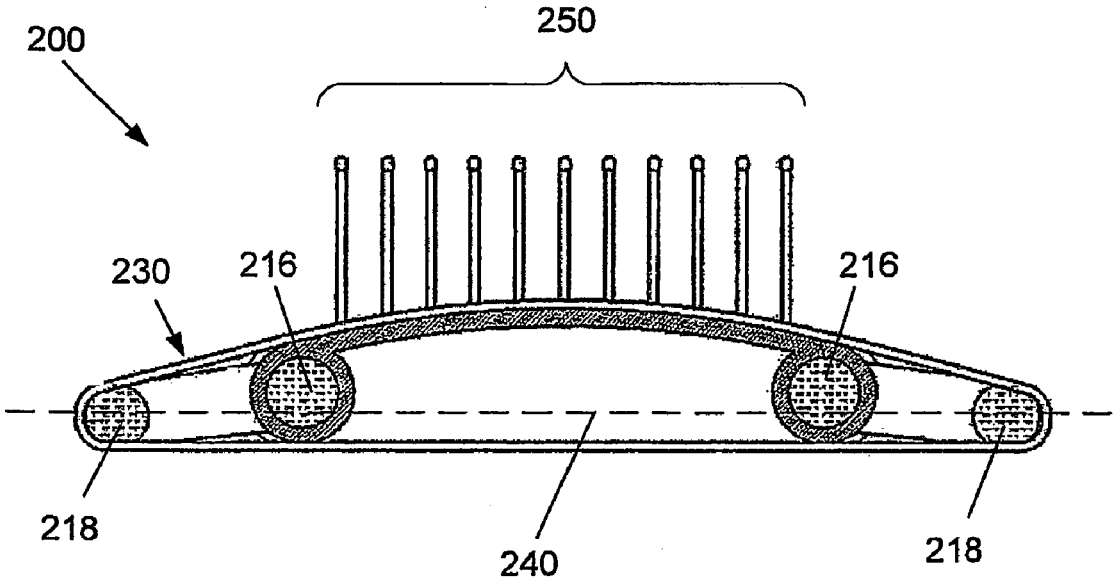
Figure 9D:
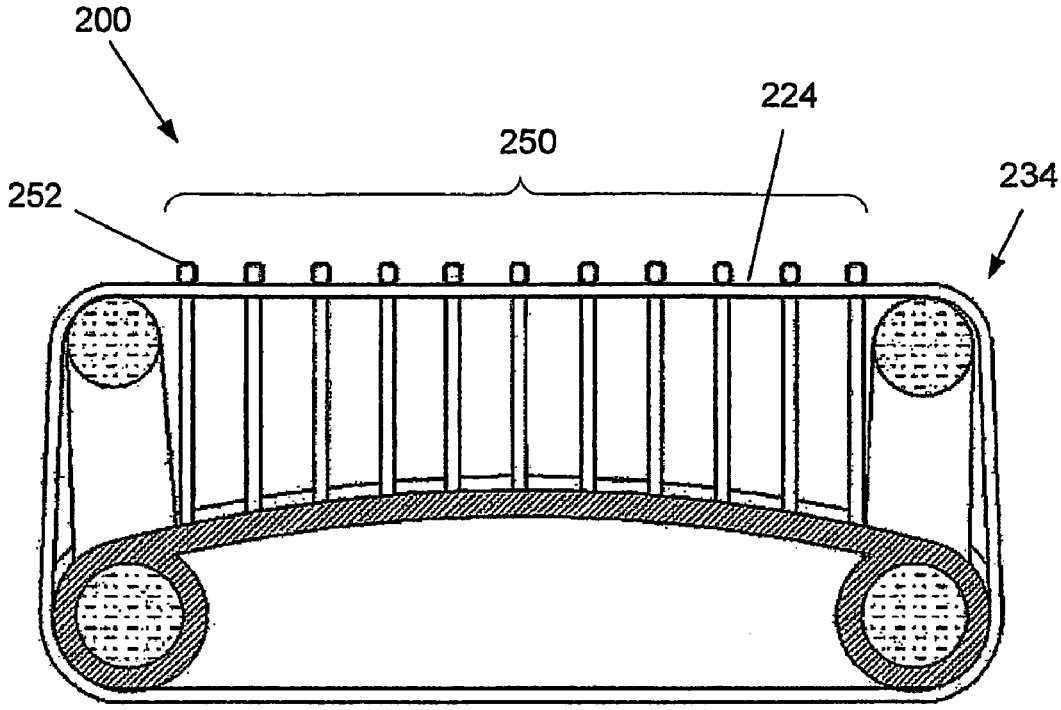

FIGS. 8*a* through 8*d* show the sequence of operations required to shift hairbrush (200) from an initial position (FIG. 8*a*) to a final position (FIG. 8*d*). FIGS. 9*a* through 9*d* show cross-sectional views of hairbrush (200) taken along E-E through H-H of FIGS. 8*a* through 8*d*. FIG. 8*a* is essentially identical to FIG. 6*a*, and shows, along with FIG. 9*a*, hairbrush (200) in the initial position. In the initial position, upper handle member (212) covers lower handle member (214), thereby forming elongated handle (210). Additionally, in the initial position, the upper surface (224) of elastic sleeve (234) rests on the surface of inner plate (232) such that essentially the entire length of bristles (250) protrudes through apertures (236) in elastic sleeve (234). As seen in FIG. 9*a*, inner and outer rods (218), (216) are aligned essentially along a plane, as indicated by centerline (240). FIGS. 8*b* and 9*b* show the first intermediate position of hairbrush (200), wherein each handle member (212), (214) is rotated outwardly downward, as indicated by arrows (220), about the longitudinal axis of each respective outer rod (216), such that handle members (212), (214) are essentially parallel with each other. The lower surface (226) of elastic sleeve (234) stretches downward accordingly, and the upper surface (224) of elastic sleeve (234) remains in contact with the surface of inner plate (232). A second intermediate position of hairbrush (200) is shown in FIGS. 8*c* and 9*c*, wherein each handle member (212), (214) is further rotated outwardly about the longitudinal axis of each respective outer rod (216). In this position, as seen in FIG. 9*c*, inner and outer rods, (218), (216) are aligned essentially along a plane, as indicated by centerline (240). Elastic sleeve (234) is stretched along the plane indicated by centerline (240), and the upper surface of elastic sleeve (234) remains in contact with the surface of inner plate (232). In the final position of hairbrush (200), shown in FIGS. 8*d* and 9*d*, handle member (212), (214) is further rotated outwardly about the longitudinal axis of each respective outer rod (216), such that upper surface (224) of elastic sleeve (234) is upwardly stretched until it reaches the free ends of bristles (250), As seen in the figures, particularly, FIG. 9*d*, the free ends of bristles (250) preferably comprise comfort tip buttons (252). Each button (252) is typically spherical and has a thickness greater than that of each aperture (236) (FIG. 6*b*) in elastic sleeve (234) though which each associated bristle (250) protrudes. When sleeve (234) is in the final position (FIGS. 8*d* and 9*d*), buttons (252) serve as stoppers for preventing sleeve (234) from sliding off of bristles (250) and decoupling from hairbrush (200). When hairbrush (200) is situated in the final position, the hair that was trapped among bristles (250) accumulates to a common plane on the upper surface (224) of elastic sleeve (234) to allow the hair to be easily removed from hairbrush (200).

It is understood that the four positions of hairbrush (200) illustrated in the figures and described herein above are merely illustrative of the different positions of bristles (250) with respect to the upper surface of elastic sleeve (234). The shifting of hairbrush (200) from the initial to final position is typically performed in a single, uninterrupted motion.

It is further understood that the angles of rotation and/or planar references as mentioned herein above are not meant to be limitative, but rather describe the stages of operation for the particular embodiment shown in the figures. When the dimensions of the hairbrush (200) are altered, angles of rotation as well as planar alignments may change accordingly.

Figure 10A:
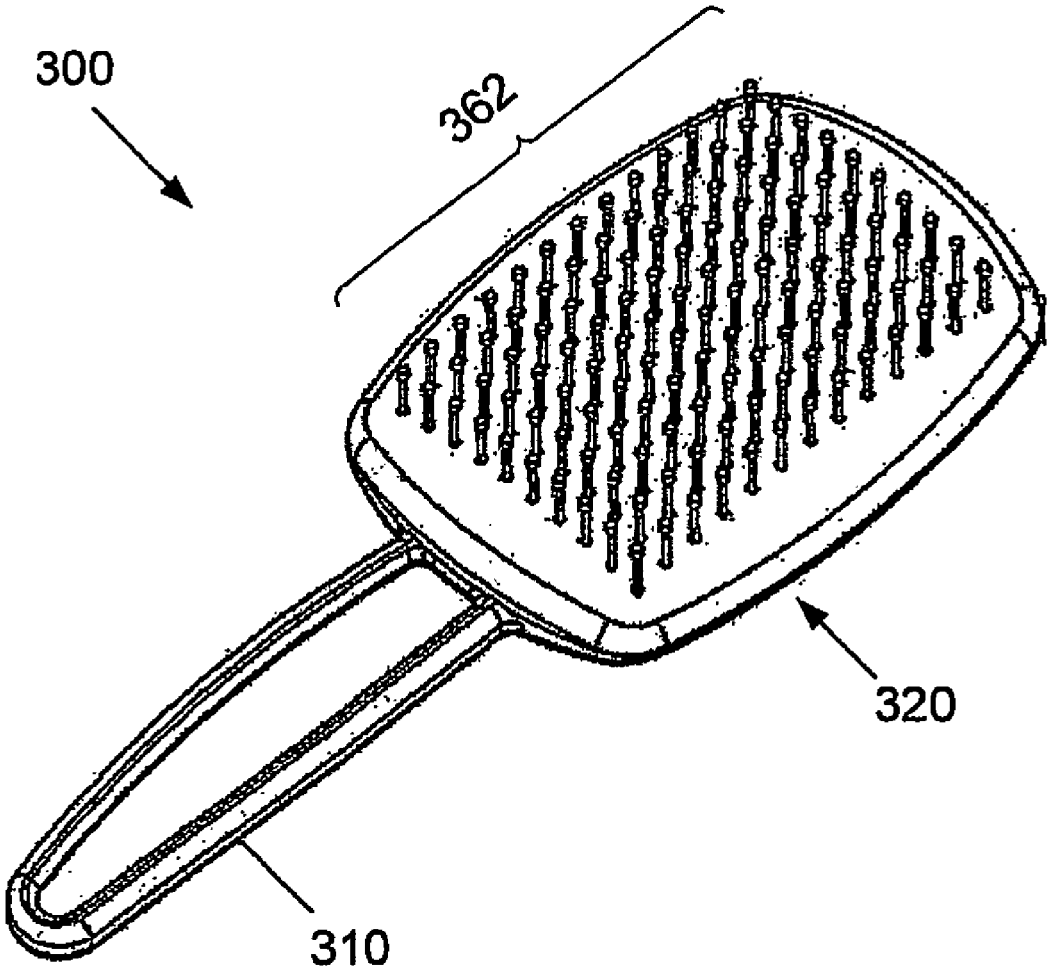
FIGS. 10*a* and 10*b* illustrate a front perspective view (FIG. 10*a*) and a back perspective view (FIG. 10*b*) of the third embodiment of the hairbrush of the present invention.
Figure 10B:
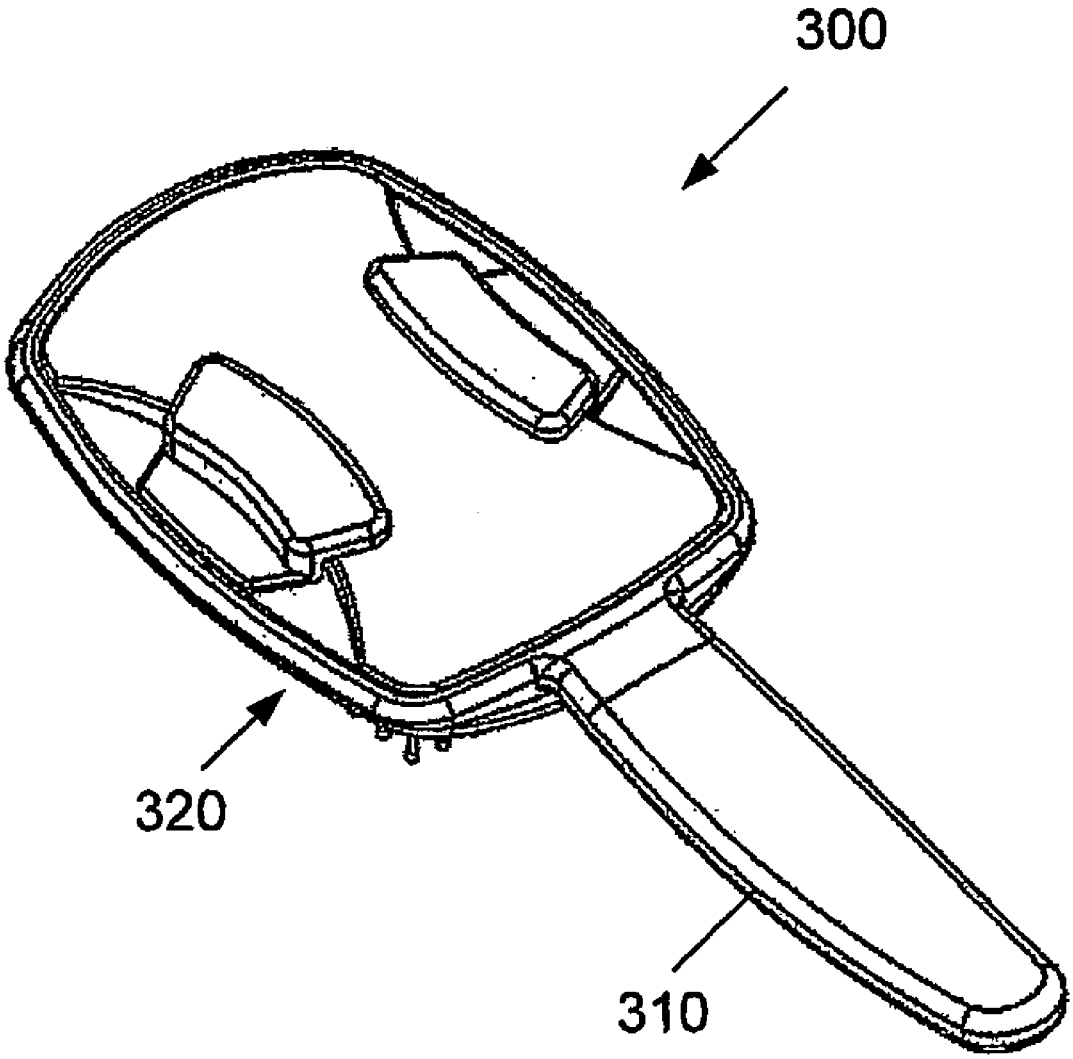

A third embodiment of the hairbrush of the present invention, shown in a front perspective view in FIG. 10*a* and a back perspective view in FIG. 10*b*, and generally designated by the numeral (300), has the appearance of a conventional hairbrush, and comprises a handle (310), a head (320) and bristles (362).

Figure 11A:
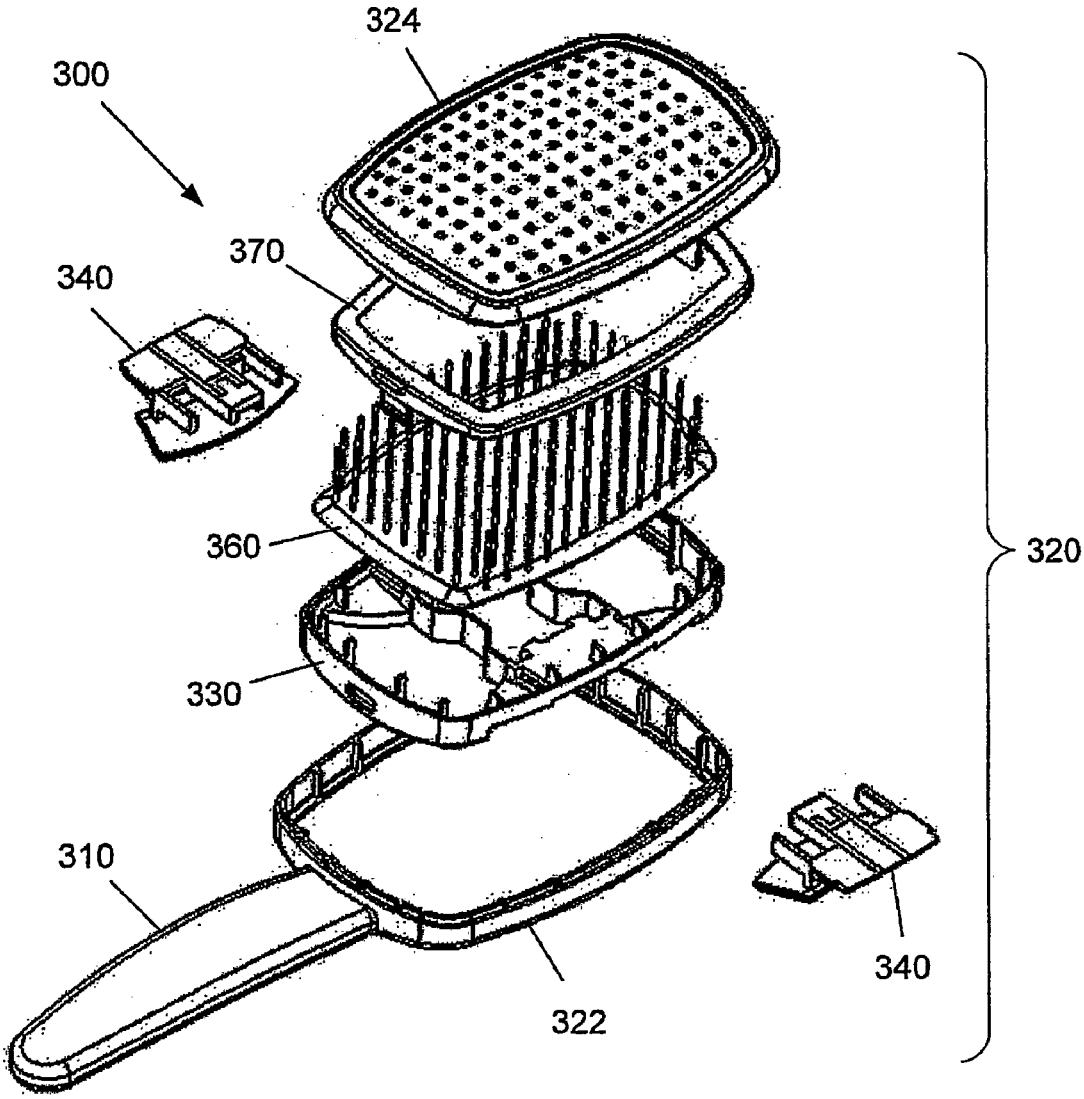
FIG. 11*a* illustrates an exploded front view of all of the components of the third embodiment of the hairbrush of the present invention.

An exploded front perspective view of all of the components of brush (300) can be seen in FIG. 11*a*. Brush (300) consists of a fixed portion comprising handle (310) and outer frame (322), and fixed upper plate (324). Brush (300) further consists of a shiftable portion comprising supporting layer (330), shiftable plate (360) and inner frame (370). Releasing members (340) are insertable to supporting layer (330), as described herein below.

Figure 11B:
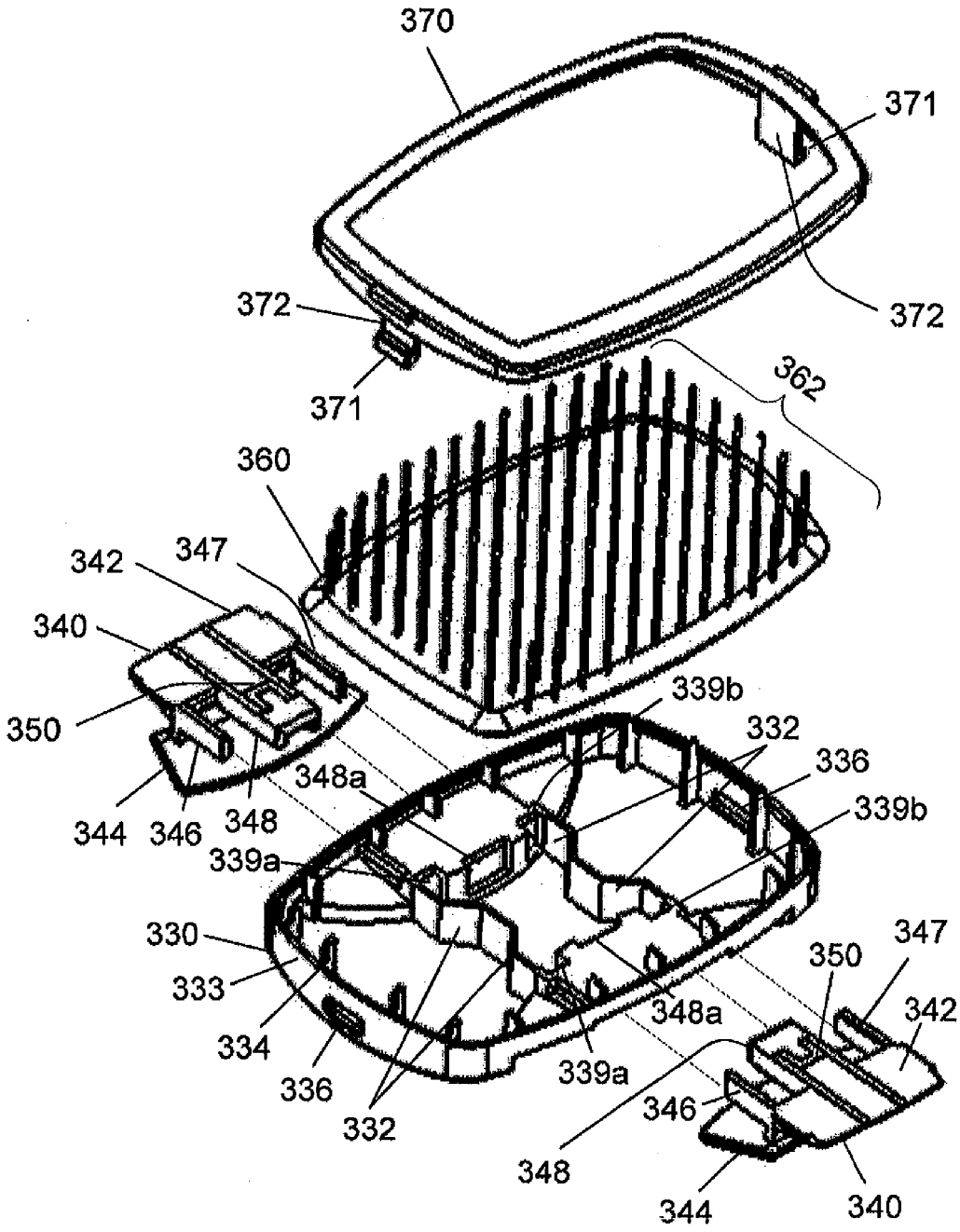
FIG. 11*b* illustrates an exploded front view of the components of the shiftable portion of the hairbrush of the present invention.
Figure 11C:
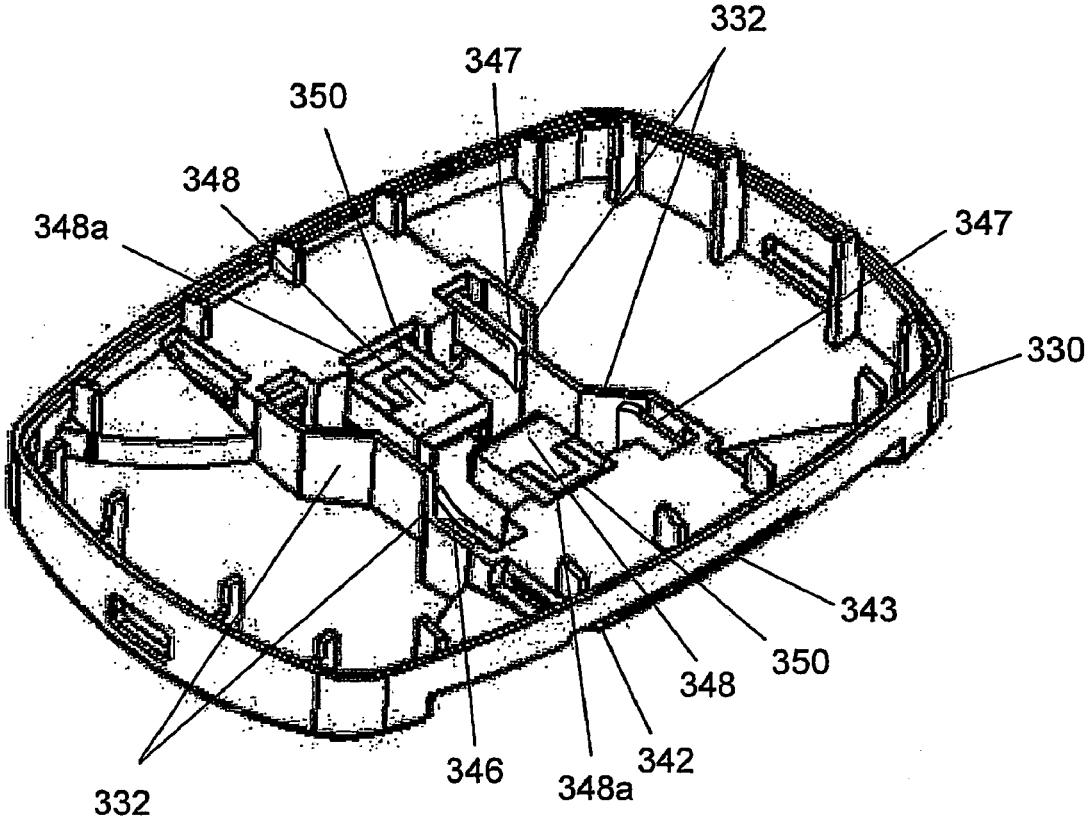
FIG. 11*c* illustrates the supporting layer wherein the releasing members are fully inserted therein.

FIG. 11*b* shows the components of the shiftable portion of brush (300) in an exploded view. Each releasing member (340) comprises an upper portion (342) and a lower portion (344). A pair of flexible spring elements (346), (347) and a central element (348) extend from each releasing member (340), and are inserted through openings (339*a*), (339*b*) and (348*a*), respectively. As seen in FIG. 11*c*, when central element (348) is fully inserted to opening (348*a*), upwardly projecting lip (350) prevents central element (348) from being removed from opening (348*a*). Spring elements (346), (347) are flexible members. When inserting spring elements (346), (347) to openings (339*a*), (339*b*), the tips of spring elements (346), (347) contact the inwardly inclined walls (332). Still referring to FIG. 11*c*, when spring elements (346), (347) are further inserted, spring elements (346), (347) slide along inwardly inclined walls (332) and bend inward. The return force of each spring element (346), (347) causes releasing members (340) to be urged in opposing transversal directions, out of respective openings (339*a*), (339*b*). However, lip (350) prevents outward sliding of releasing member (340), as described above.

Again referring to FIG. 11*b*, shiftable plate (360) is preferably a flexible layer, made of, for example, rubber, and comprises an array of bristles (362) upwardly projecting therefrom. When the shiftable portion is assembled, shiftable plate (360) is situated on top of supporting layer (330). A plurality of inner ribs (334) situated along the inner periphery of the outer wall (333) of supporting layer (330) project upward to provide support of shiftable plate (360) around the edges thereof.

Figure 11D:
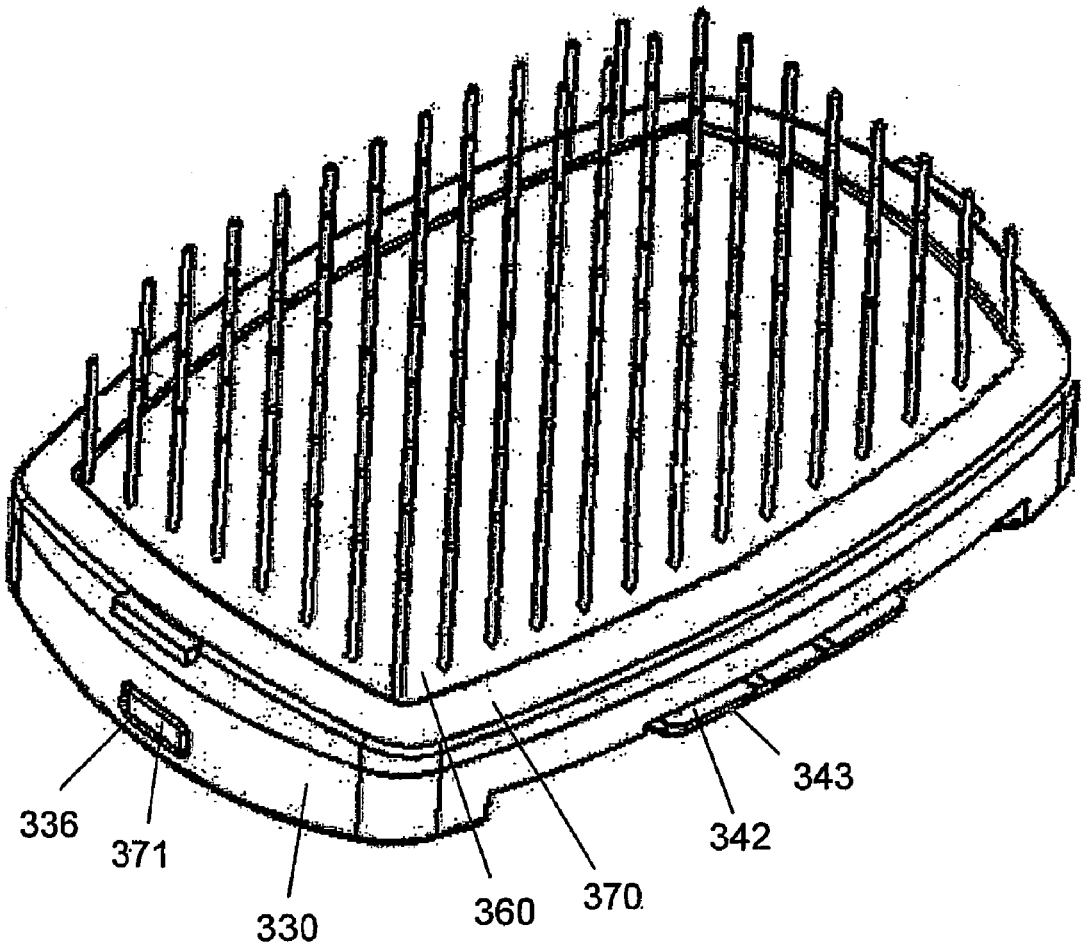
FIG. 11*d* illustrates the shiftable portion in an assembled view.

As best seen in FIG. 11*d*, showing the shiftable portion fully assembled, inner frame (370) is positioned on top of the periphery of shiftable plate (360). Referring to FIGS. 11*b* and 11*d*, depending tabs (372) (only seen in FIG. 11*b*) comprise a lower portion (371) for securely fitting into slot (336) in supporting layer (330), thereby securely joining the components of the shiftable portion together.

As seen in FIGS. 11*c* and 11*d*, outer edge (343) of upper portion (342) of releasing members (340) protrudes from transverse sides of supporting layer (330), and serves as a stopper for preventing the shiftable portion of brush (300) from undesirable shifting, as described herein below.

Figure 11E:
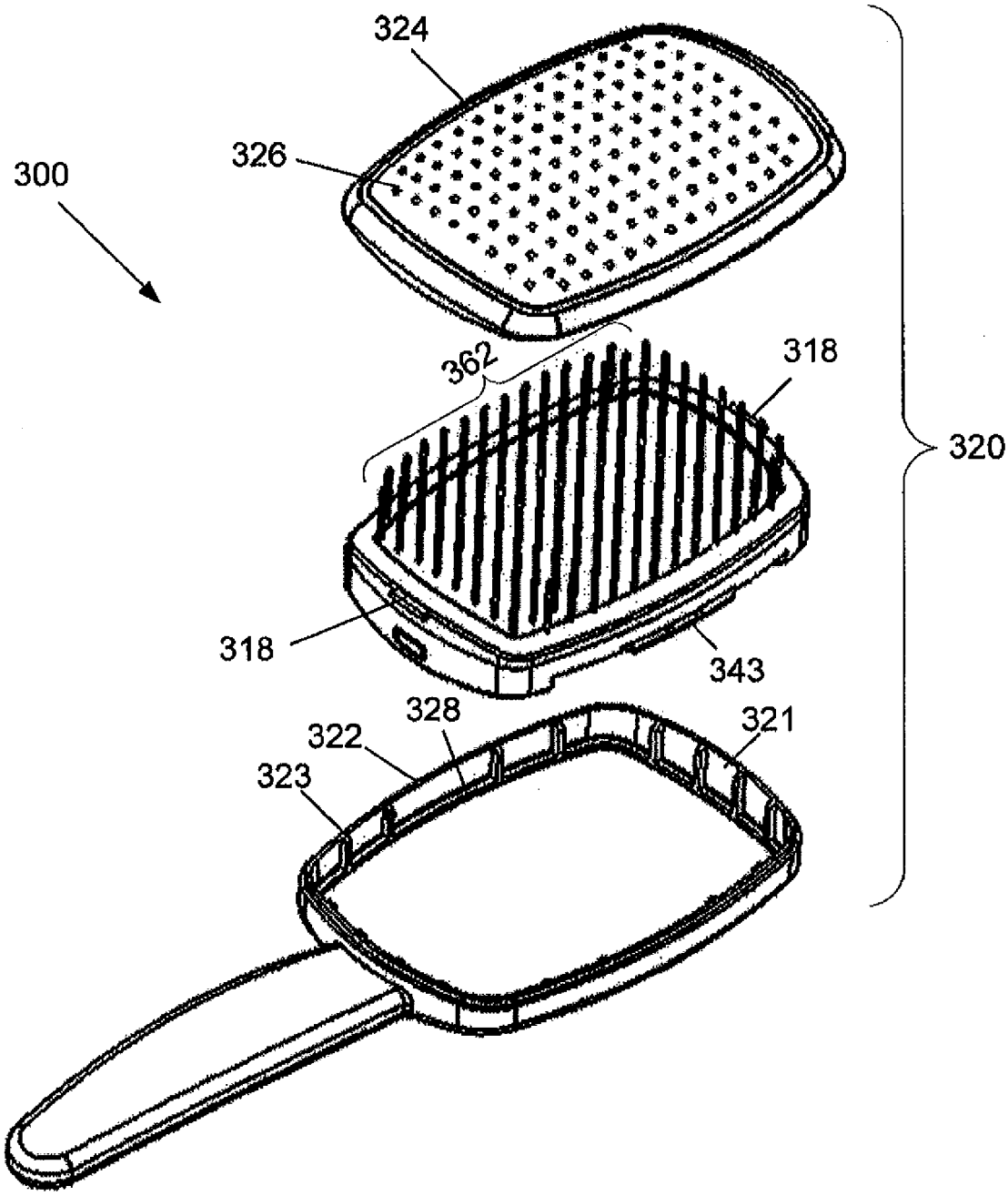
FIG. 11*e* illustrates an exploded front view of the components of the fixed portion, and an assembled view of the shiftable portion.

FIG. 11*e* shows the components of the fixed portion of brush (300) in an exploded view, and the shiftable portion in an assembled view. Fixed upper plate (324) comprises an array of apertures (326) through which bristles (362) protrude, when head (320) is fully assembled (FIG. 10*a*). Upper plate (324) is preferably made of a rigid plastic material. A plurality of outer ribs (323) situated along the inner periphery of outer wall (321) of outer frame (322) serve as guides for allowing the shiftable portion to shift evenly through outer frame (322), as described herein below.

Figure 12A:
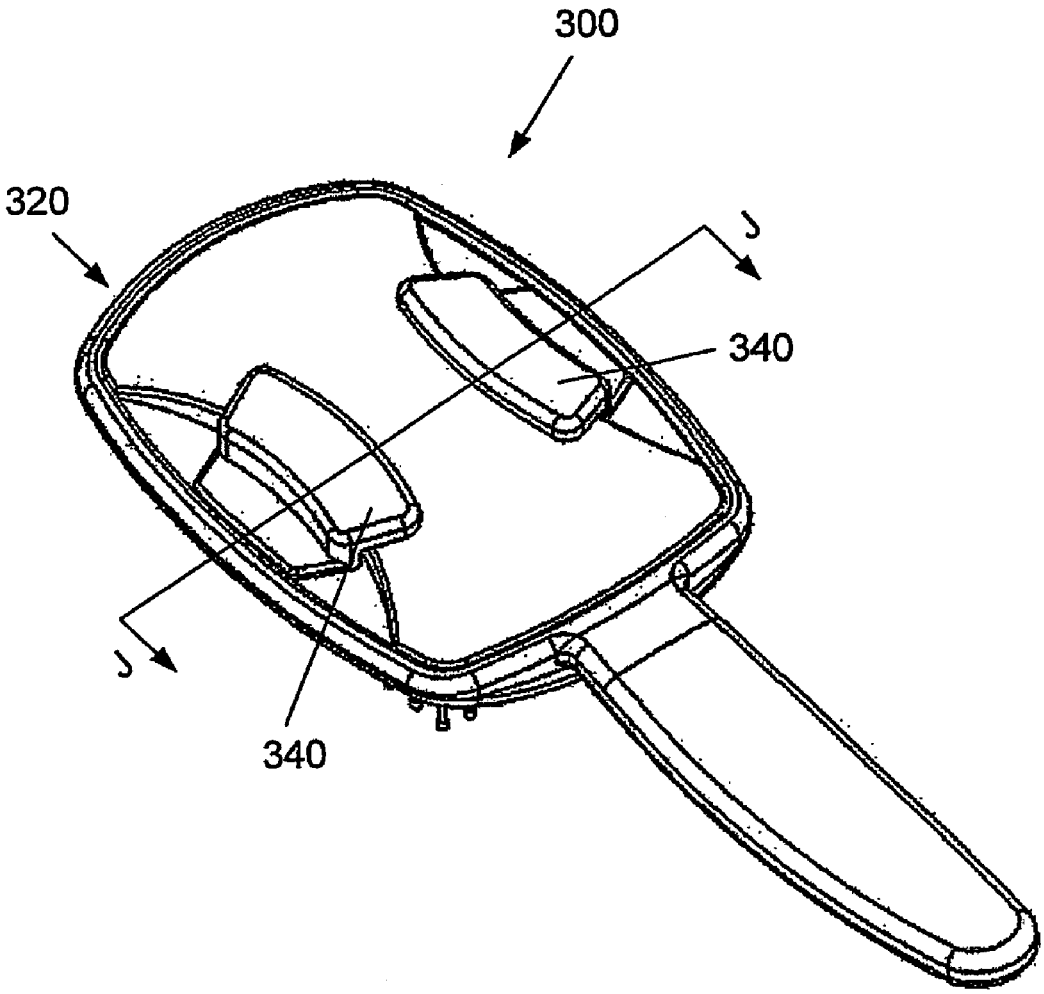
FIGS. 12*a*-12*c* illustrate a back perspective view of the sequence of operations required to shift the hairbrush of the third embodiment, from the initial position (FIG. 12*a*) to the intermediate position (FIG. 12*b*) to the final position (FIG. 12*c*).
Figure 12B:
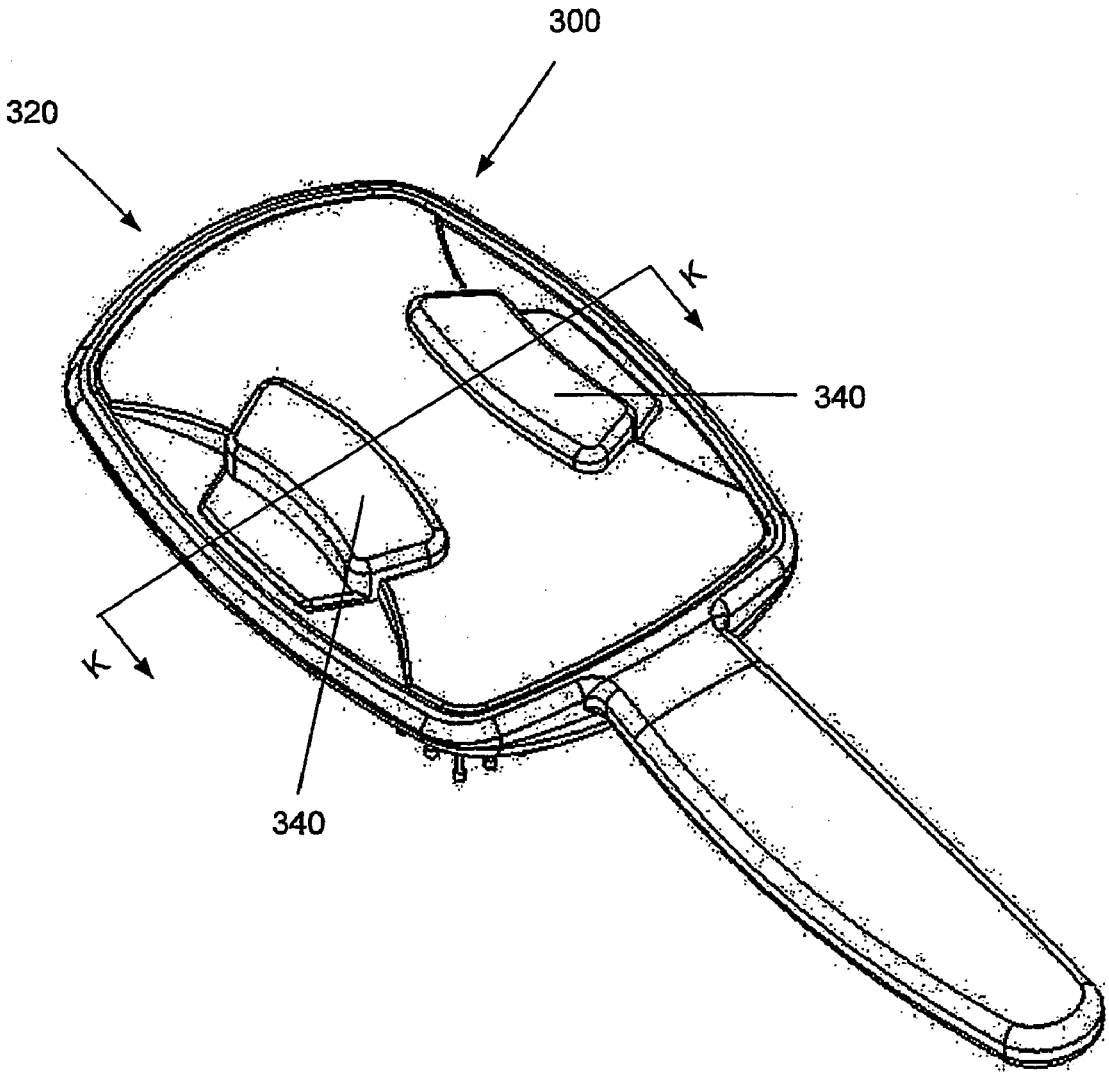
Figure 12C:
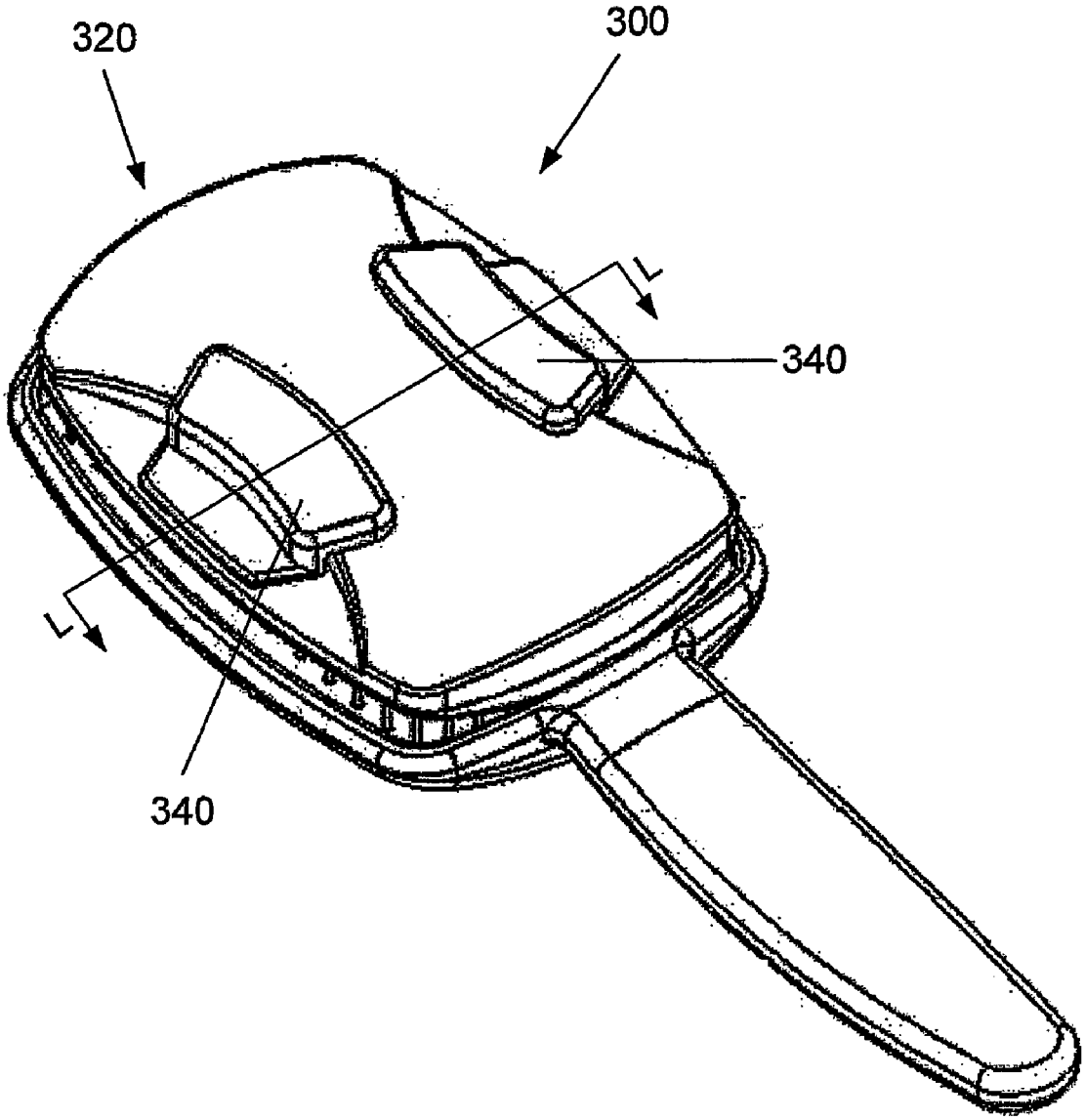
Figure 13A:
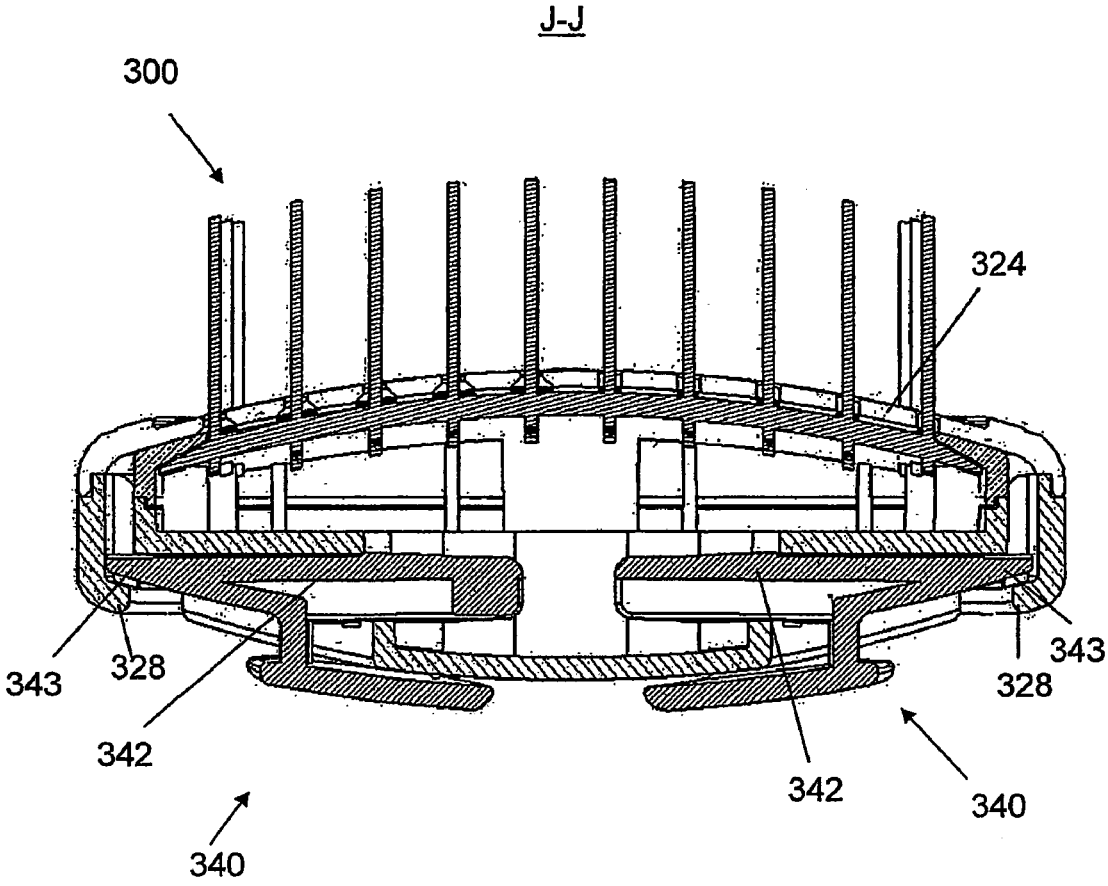
FIGS. 13*a*-13*c* illustrate cross-sectional views taken along J-J (FIG. 12*a*), K-K (FIG. 12*b*) and L-L (FIG. 12*c*) of FIGS. 12*a*-12*c* respectively.
Figure 13B:
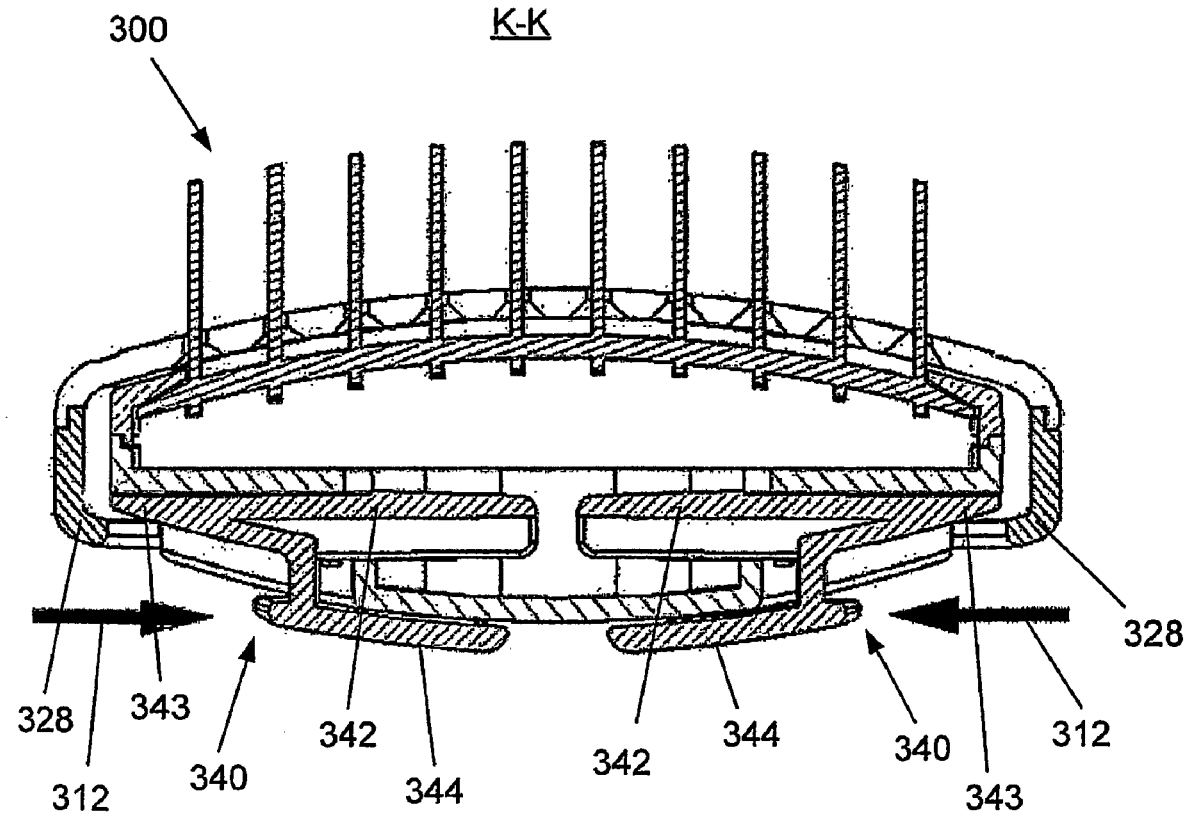
Figure 13C:
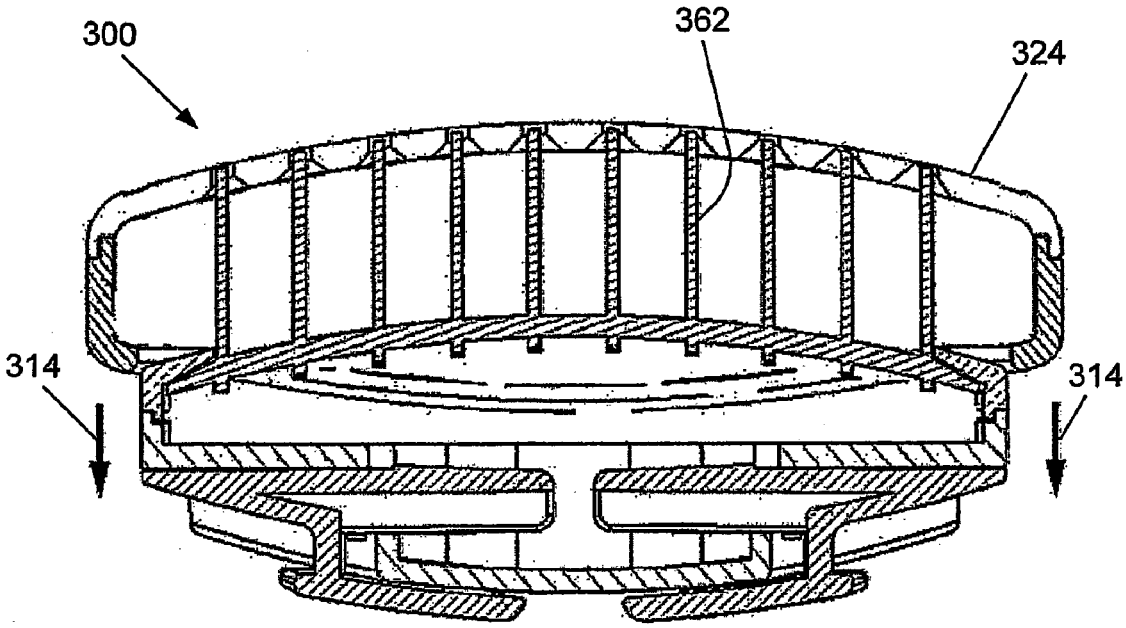

FIGS. 12*a* through 12*c* show brush (300) in a back perspective view, showing the sequence of operations required to shift hairbrush (300) from an initial position (FIG. 12*a*) to a final position (FIG. 12*c*). FIGS. 13*a* through 13*c* show cross-sectional front views of hairbrush (300) taken along J-J through L-L of FIGS. 12*a* through 12*c*. FIG. 12*a* is essentially identical to FIG. 10*a*, and shows, along with FIG. 13*a*, hairbrush (300) in the initial position. Referring to FIG. 13*a*, in the initial position, outer edge (343) of upper portion (342) of releasing member (340) is disposed overlapping lower lip (328) (see also FIG. 11*e*) of outer frame (322), thereby preventing the shiftable portion from shifting downward. Fixed upper plate (324) prevents shiftable portion from shifting upward. FIGS. 12*b* and 13*b* show the intermediate position of hairbrush (300), wherein releasing elements (340) are shifted inward, in the direction indicated by arrows (312) (FIG. 13*b*), as a result of the necessary force applied to lower portion (344), preferably by the user's fingers. Releasing elements (340) may be maintained in the intermediate position as long as the necessary force is applied thereto. However, once the force is removed (i.e. the user's fingers are removed), spring members (346), (347) (see FIG. 11*c*) urge releasing elements (340) to return to their initial position (FIGS. 12*a* and 13*a*). In the final position of hairbrush (300), shown in FIGS. 12*c* and 13*c*, the shiftable portion is shifted downward, as indicated by arrows (314) (FIG. 13*c*), relative to the fixed portion, until the free ends of bristles (350) contact fixed plate (324).

Figure 14:
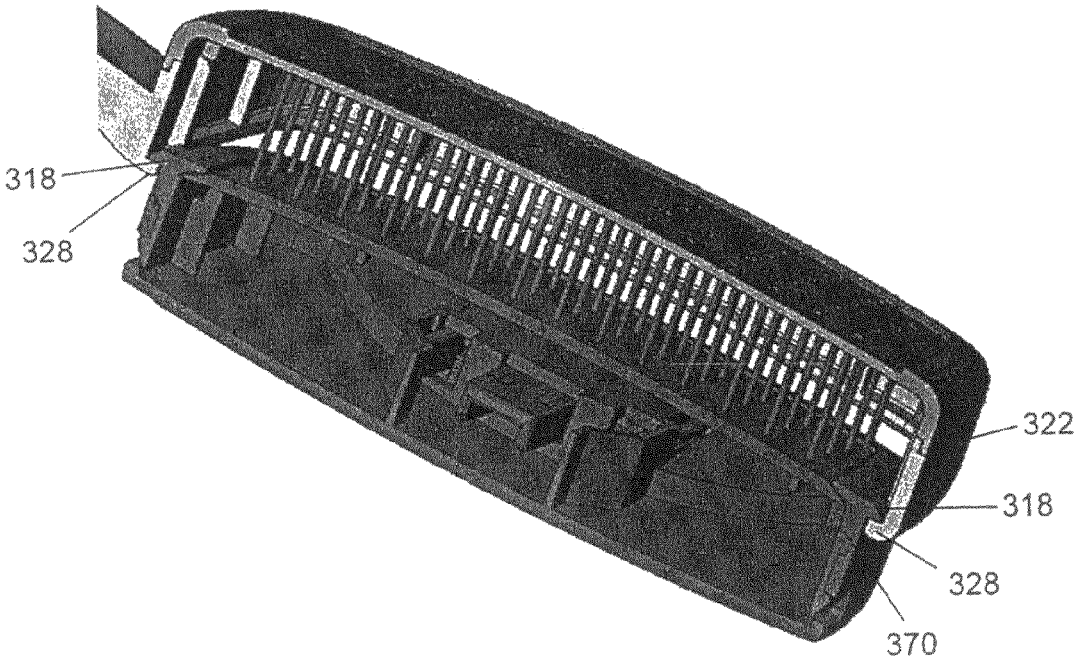
FIG. 14 illustrates a longitudinal cross-sectional view of a three-dimensional model of the third embodiment of the present invention, showing the hairbrush in a final position.

As seen in FIG. 11*e* primary stoppers (318) extend outward from the longitudinal ends of inner frame (370). FIG. 14 shows a longitudinal cross-section of a three-dimensional model of brush (300), in the final position. When the shiftable portion is shifted downward, lower lip (328) catches primary stoppers (318), thereby preventing the shiftable portion from disengaging from the outer frame (322).

Although not shown in the figures, the free ends of bristles (362) preferably comprise comfort tip buttons. Each button is typically spherical and has a thickness greater than that of each aperture (326) in fixed plate (324) though which each associated bristle (362) protrudes. When brush (300) is in the final position (FIGS. 12*c*, 13*c* and 14), the buttons serve as secondary stoppers for the shiftable portion from sliding off of fixed plate (324) and decoupling from hairbrush (300). When hairbrush (300) is situated in the final position, the hair that was trapped among bristles (362) accumulates to a common plane on the upper surface of fixed plate (324) to allow the hair to be easily removed from hairbrush (300).

It is understood that the three positions of hairbrush (300) illustrated in the figures and described herein above are merely illustrative of the different stages of the operation of hairbrush (300). The shifting of hairbrush (300) from the initial to final position is typically performed in a single, uninterrupted motion.

Figure 15A:
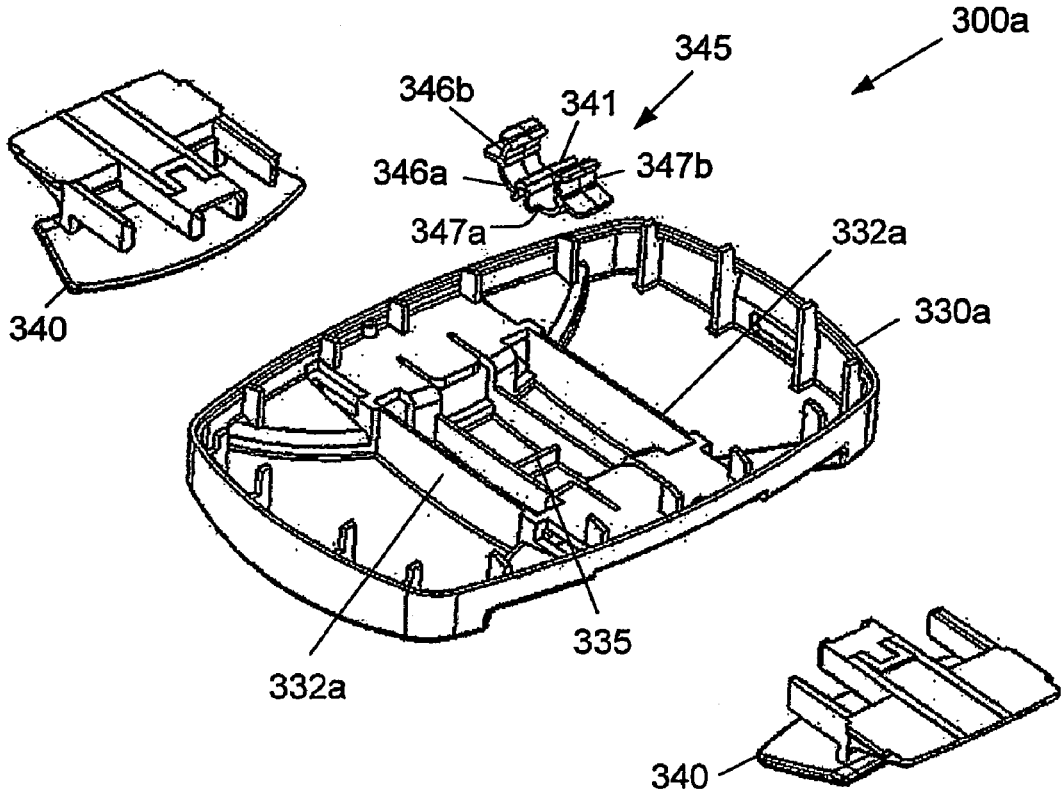
FIGS. 15*a*-15*b* illustrate an alternative aspect of the third embodiment in exploded (FIG. 15*a*) and assembled (FIG. 15*b*) views.

An alternative aspect of the third embodiment is shown in FIGS. 15*a*-16*c* and generally designated by the numeral (300*a*), and comprises all of the elements, features and advantages of the third embodiment (300), mutatis mutandis, with the following differences. FIG. 15*a* shows the components of the brush in this aspect (300*a*) in a view essentially similar to that of FIG. 11*b*, with the shiftable plate and inner frame removed from the figure for purposes of clarity. As seen in FIG. 15*a*, spring element (345) comprises bridge portion (341) which, when assembled within supporting layer (330*a*) (see FIG. 15*b*) is positioned over protruding rail (335). Each flexible wing member (346*a*), (347*a*) extends arcuately from bridge portion (341), toward opposing transverse sides of supporting layer (330*a*).

Bracket portions (346*b*), (347*b*) respectively extend from the end of each wing member (346*a*), (347*a*). Also, as seen in FIGS. 15*a* and 15*b*, side walls (332*a*) of the inner portion of supporting layer (330*a*) are essentially linear, as opposed to the inwardly inclined walls (332) of brush (300).

Figure 15B:
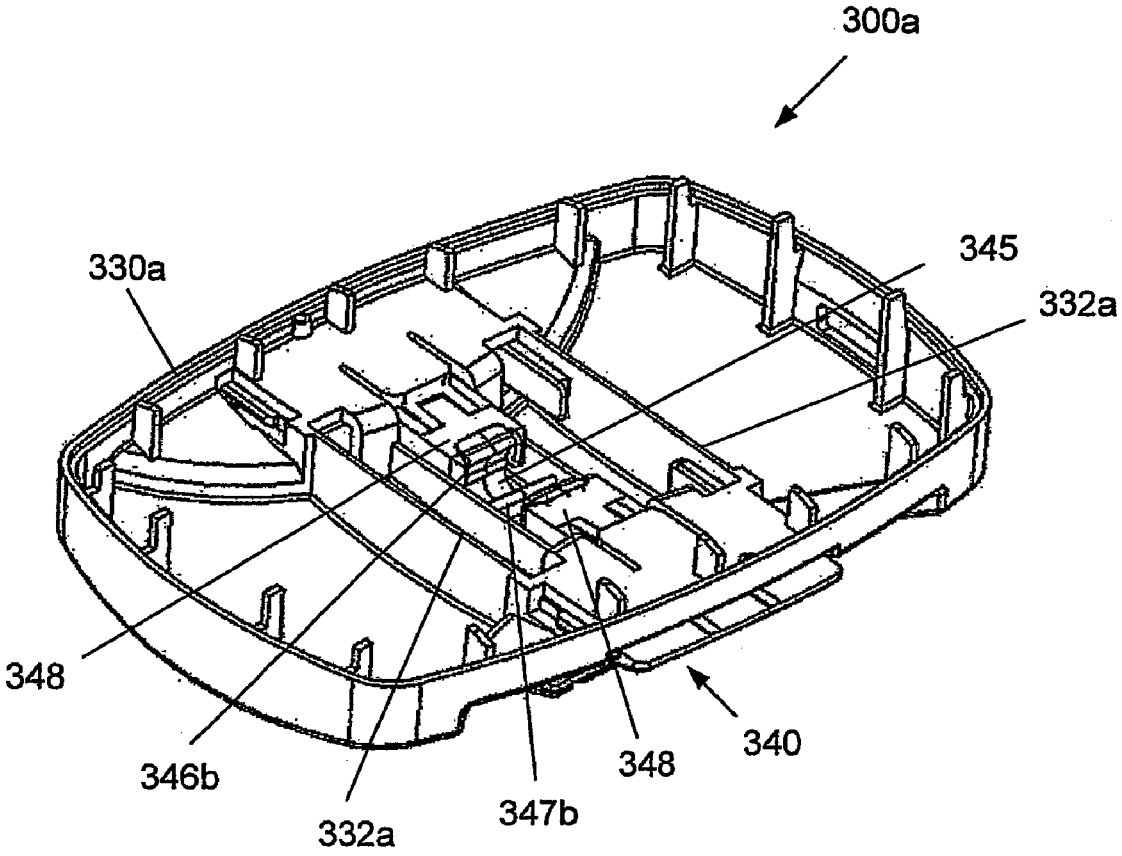
Figure 16A:
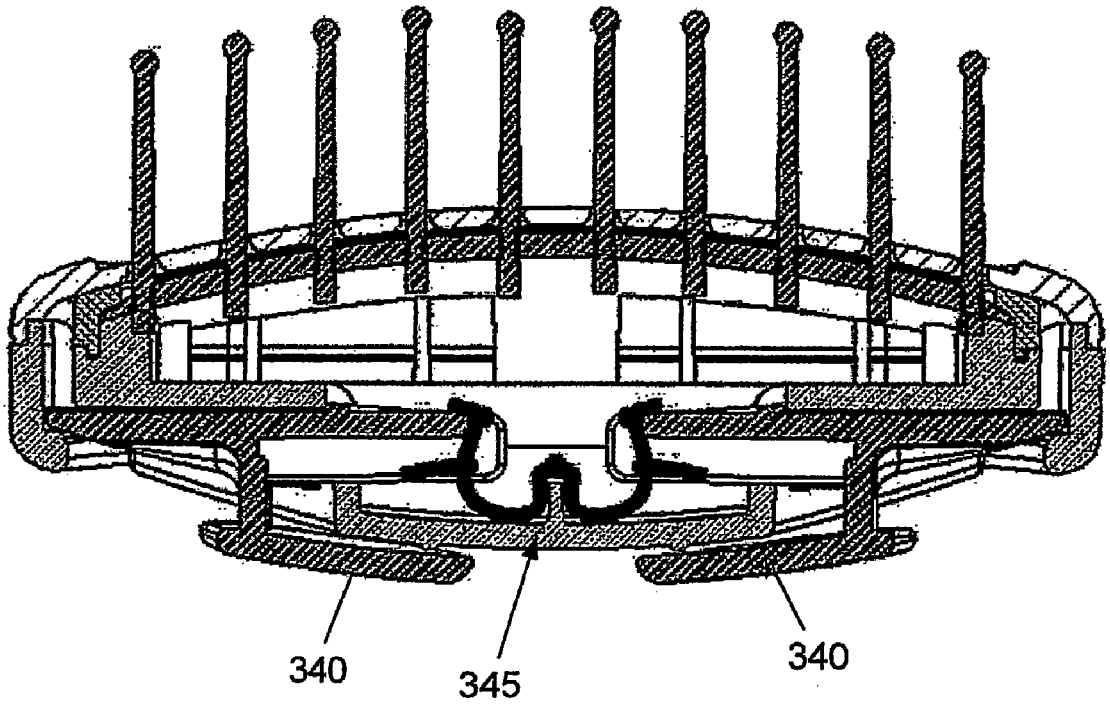
FIGS. 16*a*-16*c* illustrate cross sectional views of the alternative aspect of the third embodiment in initial (FIG. 16*a*), intermediate (FIG. 16*b*) and final (FIG. 16*c*) positions.
Figure 16B:
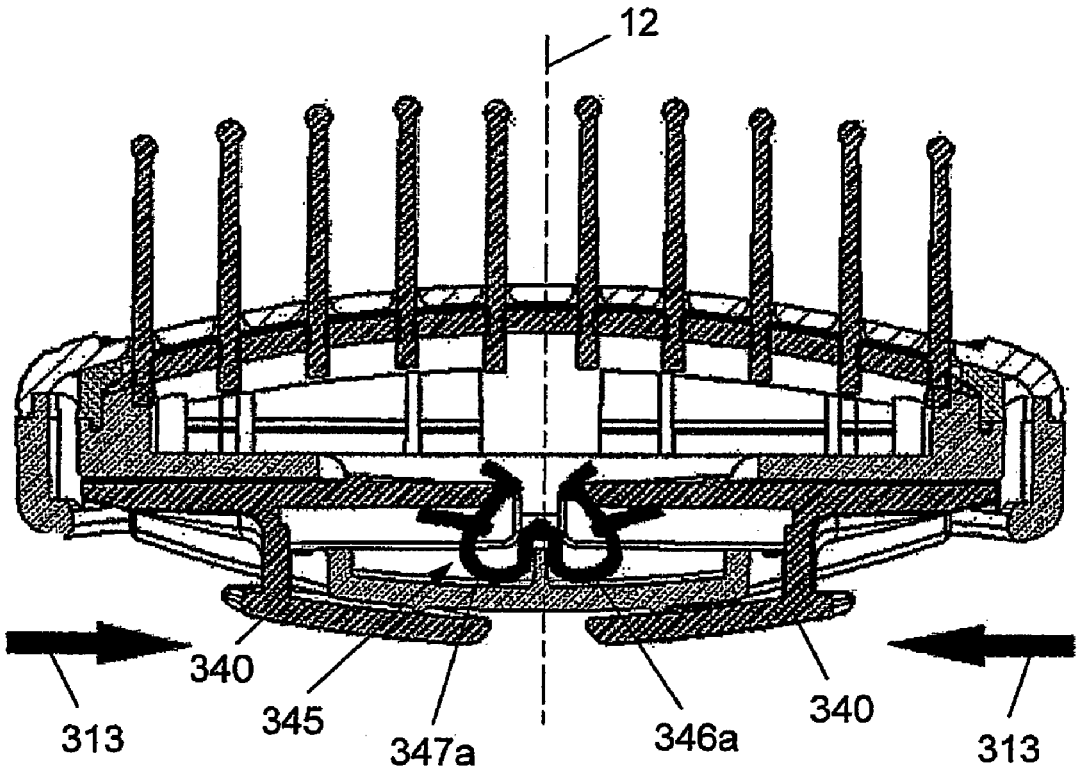
Figure 16C:
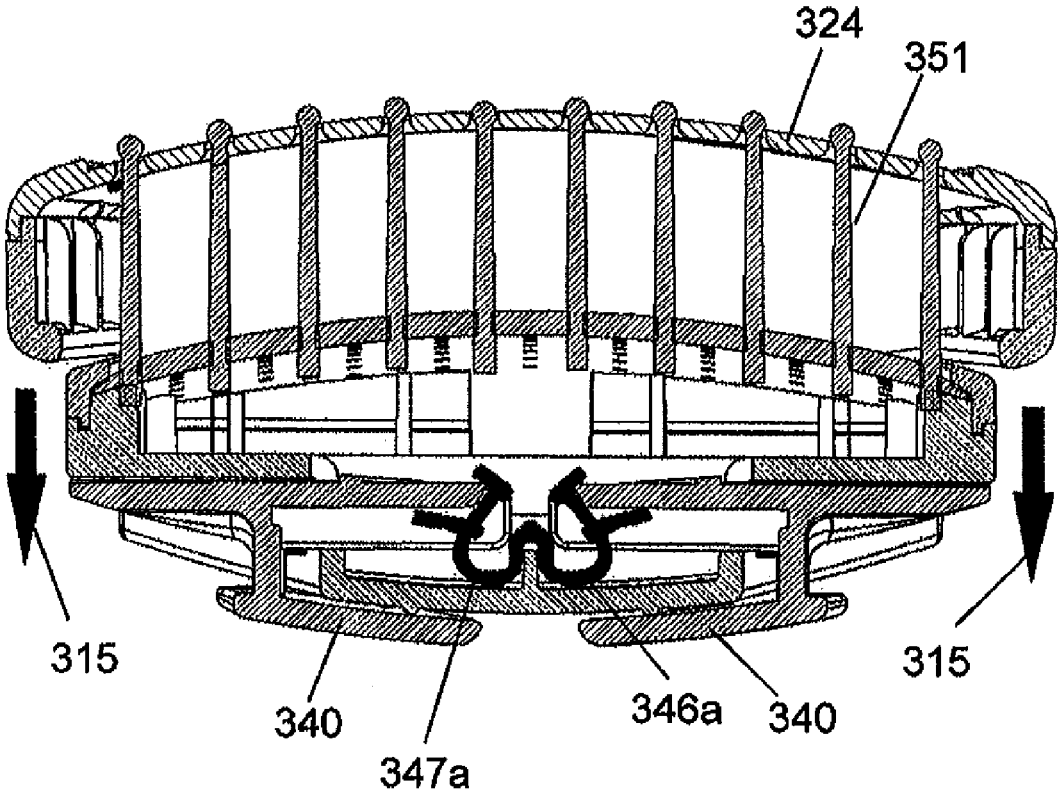

FIG. 15*b* shows supporting layer (330*a*) with releasing elements (340) and spring element (345) assembled therein. Central element (348) of each releasing element (340) is disposed within respective bracket portions (346*b*), (347*b*), as best seen in FIGS. 16*a*-16*c*. A cross-sectional view of aspect (300*a*) in the initial position is shown in FIG. 16*a*, which is essentially similar to the view of FIG. 13*a*, wherein spring element (345) is positioned in its natural state between releasing elements (340). As seen in the intermediate position in FIG. 16*b*, which is essentially similar to FIG. 13*b*, with the addition of spring element (345), when releasing elements (340) are shifted inwards, as indicated by arrows (313) each wing member (346*a*), (347*a*) is forced inward toward the central axis (12) of the brush. FIG. 16*c* shows the final position of the brush wherein the shiftable portion is shifted downward, as indicated by arrows (315), relative to the fixed portion, until the free ends of bristles (351) contact fixed plate (324). The return force of each wing member (346*a*), (347*a*) causes the wing members to desire to return to their initial position, which in turn, urges releasing elements (340) to return to their initial position. Therefore it is necessary to apply a constant force to releasing elements (340) until it is desired that releasing elements (340) return to their initial position.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. A hairbrush for allowing trapped hair to be easily removed therefrom by shifting said hairbrush from an initial position to a final position, said hairbrush comprising:

a. a handle for grasping said hairbrush; and, b. a head joined to said handle comprising:

i. a shiftable portion comprising:

1. a shiftable plate comprising an array of bristles projecting therefrom;
2. a supporting layer for supporting said plate;
3. an inner frame surrounding said shiftable plate and engaged with said supporting layer; and,
4. a pair of releasing members situated within said supporting layer;

ii. a fixed portion comprising:

1. a fixed upper plate comprising an array of apertures through which said bristles protrude; and,
2. an outer frame engaged with said fixed plate;

wherein the handle is elongate and defines a longitudinal axis that coincides with said head;

wherein said releasing members are situated along a single plane on opposite sides of the longitudinal axis of said hairbrush and are shiftable along said plane between an initial position and a shifted position, wherein when said releasing members are in said initial position, said brush is in said initial position and said shiftable portion is prevented from being shifted;

wherein when said releasing members are in said shifted position, said brush is in said final position and said shiftable portion is shiftable relative to said fixed portion.

2. A hairbrush according to claim 1, wherein when the releasing members are in the shifted position a spring element urges said releasing members to return to the initial position.

3. A hairbrush according to claim 2, wherein the spring element is an integral component of the releasing member.

4. A hairbrush according to claim 2, wherein the spring element is an independent component of the shiftable portion.

5. A hairbrush according to claim 1, wherein each releasing member comprises an upper portion provided with at least one element insertable in a corresponding opening formed in the supporting layer of the shiftable portion and a lower portion disposed externally from the supporting layer.

6. A hairbrush according to claim 5, wherein an outer edge of the releasing member, when each releasing member is in the initial position, protrudes from a corresponding transverse side of the supporting layer and overlaps a lower lip of the outer frame of the fixed portion, thereby preventing the shiftable portion from being downwardly shifted while being prevented from being upwardly shifted by means of the upper plate of the fixed portion.

7. A hairbrush according to claim 6, wherein the pair of releasing members are inwardly shiftable to the shifted position upon application of a force to the lower portion thereof, to release the outer edge of the releasing members from the corresponding lip of the outer frame and to allow the shiftable portion to be downwardly shifted.

8. A hairbrush according to claim 1, wherein in the initial position said hairbrush is usable for brushing hair, and in the final position, said trapped hair is easily removable from said hairbrush.

9. A hairbrush according to claim 1, wherein the shiftable plate is made of a flexible material.

* * * * *